US012029310B2

(12) United States Patent
Pierce et al.

(10) Patent No.: US 12,029,310 B2
(45) Date of Patent: Jul. 9, 2024

(54) COMPLETE ORAL CARE TOOTHBRUSH SYSTEMS

(71) Applicants: Stephanie M. Pierce, Brandon, FL (US); Preston E. Pierce, Brandon, FL (US)

(72) Inventors: Stephanie M. Pierce, Brandon, FL (US); Preston E. Pierce, Brandon, FL (US)

( * ) Notice: Subject to any disclaimer, the term of this patent is extended or adjusted under 35 U.S.C. 154(b) by 138 days.

(21) Appl. No.: 17/896,378

(22) Filed: Aug. 26, 2022

(65) Prior Publication Data

US 2023/0346114 A1 Nov. 2, 2023

Related U.S. Application Data

(60) Provisional application No. 63/336,451, filed on Apr. 29, 2022, provisional application No. 63/241,617, filed on Sep. 8, 2021.

(51) Int. Cl.
*A46B 11/00* (2006.01)
*A46B 7/02* (2006.01)
(Continued)

(52) U.S. Cl.
CPC ..... *A46B 11/0006* (2013.01); *A46B 7/023* (2013.01); *A46B 9/04* (2013.01);
(Continued)

(58) Field of Classification Search
CPC ..... A46B 11/0006; A46B 11/0065; A46B 11/0037; A46B 15/0061; A46B 7/023;
(Continued)

(56) References Cited

U.S. PATENT DOCUMENTS 1,279,507 A * 9/1918 Briggs ..... A61C 15/041 401/137
2,025,591 A * 12/1935 Folsom-Jones .... A46B 11/0006 401/175
(Continued)

FOREIGN PATENT DOCUMENTS

CN 2815919 Y 9/2006
CN 201094587 Y 8/2008
(Continued)

*Primary Examiner* — David J Walczak
(74) *Attorney, Agent, or Firm* — Shumaker, Loop & Kendrick, LLP; Jeffrey B. Fabian

(57) ABSTRACT

An oral care system includes a main body, and a brush manually movable between a stowed and a deployed position. The brush includes a head, and bristles having respective first ends attached to the head and distal ends together defining a bristle surface for tooth cleaning in use. A toothpaste dispensing apparatus is carried by the main body and is configured to place toothpaste directly onto the bristle surface defined by the distal ends of the bristles when the brush is in the stowed position. The dispensing apparatus is configured to place toothpaste directly onto the bristle surface defined by the distal ends of the bristles without saturating the bristles at their first ends attached to the head. The toothpaste dispensing apparatus includes a port through which toothpaste is dispensed, and the port aligns with the bristles when the brush is at the stowed position.

13 Claims, 39 Drawing Sheets

(51) Int. Cl.
*A46B 9/04* (2006.01)
*A46B 15/00* (2006.01)

(52) U.S. Cl.
CPC ..... *A46B 11/0037* (2013.01); *A46B 11/0065* (2013.01); *A46B 15/0061* (2013.01); *A46B 11/0062* (2013.01); *A46B 2200/1066* (2013.01)

(58) Field of Classification Search
CPC ... A46B 9/04; A46B 2200/1066; A46B 11/00; A46B 11/001; A46B 11/002; A46B 11/0027; A46B 11/0062
USPC ..... 401/123, 125, 116, 270, 272, 277
See application file for complete search history.

(56) References Cited

U.S. PATENT DOCUMENTS 3,816,007 A * 6/1974 Fox ..... A46B 11/0006 401/269
4,056,110 A * 11/1977 Landsman ..... A45D 44/18 401/129
4,277,195 A 7/1981 Smith
4,424,916 A 1/1984 Pearson
4,508,239 A 4/1985 Rozzen
4,695,177 A * 9/1987 Kuo ..... A46B 11/0006 401/176
5,100,252 A 3/1992 Podolsky
7,021,851 B1 4/2006 King
8,511,323 B2 8/2013 Jimenez et al.
8,534,950 B2 9/2013 Sylvester
8,727,652 B2 5/2014 Jimenez et al.
8,851,779 B2 10/2014 Jimenez et al.
8,882,380 B2 11/2014 Jimenez et al.
8,926,209 B1 1/2015 Wilcox
9,015,893 B2 4/2015 Vaynberg et al.
9,172,477 B2 11/2015 Jimenez et al.
9,173,477 B2 11/2015 Jimenez et al.
9,198,504 B2 12/2015 McCoy et al.
9,398,803 B2 7/2016 Jimenez et al.
9,427,076 B2 8/2016 Jimenez et al.
9,700,128 B2 7/2017 Kennedy et al.
9,907,391 B2 3/2018 McCoy et al.
10,010,166 B2 7/2018 Jimenez
10,154,728 B2 12/2018 Hailechristos
10,813,442 B1 10/2020 Schneier
2002/0088474 A1 7/2002 Montalvo
2013/0279964 A1 10/2013 Booker
2015/0284147 A1 10/2015 Patey

FOREIGN PATENT DOCUMENTS

CN 105173347 A 12/2015
KR 940021803 U 10/1994
KR 20200000286 U 2/2020

* cited by examiner

COMPLETE ORAL CARE TOOTHBRUSH SYSTEMS

CROSS-REFERENCE TO RELATED APPLICATIONS

This application claims the benefit of priority of U.S. provisional patent application No. 63/241,617, titled "Complete Oral Care Toothbrush System," filed on Sep. 8, 2021, and the benefit of priority of U.S. provisional patent application No. 63/336,451, titled "Complete Oral Care Toothbrush System," filed on Apr. 29, 2022, both of which are incorporated herein in entirety by this reference.

TECHNICAL FIELD

The present disclosure relates to oral hygiene products. More particularly, the present disclosure relates to systems for sanitary handling and use of a toothbrush, toothpaste, and floss in a consolidated system.

BACKGROUND

Toothpaste is a ubiquitous product and is essential for effective oral hygiene. Typically fortified with fluoride to fight cavities and periodontal disease, toothpaste is often manufactured in collapsible tubing for packaging and use. Traditionally, as part of a daily routine, toothpaste is applied to a separate toothbrush before brushing can begin. The toothbrush is held in one hand and captures paste expelled from a tube held in the opposite hand.

Over time, multiple individual brushes may come into direct contact with the nozzle of the same toothpaste tube while paste is dispensed. This occurs when, for example, toothpaste tubes are shared among family members. However, contact with multiple toothbrushes increases the risk of contamination and can spread contagions such as viral or bacterial infections. This widely accepted practice and the associated risks persist because of a lack of alternative solutions.

SUMMARY

To address the drawbacks of traditional toothpaste tubes, an oral care system is disclosed herein that minimizes or eliminates contact between a toothpaste tube and a toothbrush when dispensing toothpaste onto the toothbrush head. The toothbrush head is configurable to a stowed position to promote efficient use of space and to align the toothbrush head with a toothpaste dispensing port. Separate actuators can be used to move the toothbrush between a stowed position and an extended position and to dispense toothpaste. The use of separate actuators to move the toothbrush and to dispense the toothpaste promotes efficient and configurable placement of toothpaste on the toothbrush head. That is, use of a single actuator for both mechanisms would dispense the same amount of toothpaste each time the toothbrush is deployed, which would eliminate a user's ability to select a desired amount of toothpaste, to account for air bubbles, or to account for other interruptions in toothpaste flow from a dispenser.

The system utilizes a reusable, refillable toothpaste capsule that can be removed and cleaned between refills. The actuator components that expel toothpaste from the capsule are separate and distinct from a reservoir that stores the toothpaste to minimize or eliminate the risk that the toothpaste becomes a contaminant that impedes movement of the system components.

This summary is provided to introduce concepts that are further described in the following detailed descriptions. This summary is not intended to identify key features or essential features of the claimed subject matter, nor should it be construed as limiting the scope of the claimed subject matter.

According to one embodiment, an oral care system includes a main body, and a brush attached to the main body that is manually movable between a stowed position and a deployed position. The brush includes a head, bristles having respective first ends attached to the head, and free distal ends that together define a bristle surface for tooth cleaning. A toothpaste dispensing apparatus is carried by the main body. The toothpaste dispensing apparatus is configured to place toothpaste directly onto the bristle surface defined by the distal ends of the bristles when the brush is in the stowed position.

The dispensing apparatus may be configured to place toothpaste directly onto the bristle surface defined by the distal ends of the bristles without saturating the bristles at their first ends attached to the head. The toothpaste dispensing apparatus includes a port opening through which toothpaste is dispensed. The port aligns with the bristles when the brush is at the stowed position. Toothpaste is fed from a reservoir, through a port orifice opening, and through a conduit that extends between the port and the port orifice. The dispensing apparatus may further include a rotatable actuator, and a capsule for containing toothpaste. By rotating the rotatable actuator, toothpaste is dispensed from the capsule through the port and onto the bristle surface defined by distal ends of the bristles.

In one embodiment, the dispensing apparatus includes a post operably extended by rotation of the rotatable actuator. The post frictionally engages a plunger and pushes the plunger into the capsule. Rotating the rotatable actuator causes the plunger to compress the toothpaste, thereby dispensing the toothpaste from the capsule through the port and onto the bristle surface. The post may include two or more portions. At least one of the post portions extends telescopically relative to the other portion within the capsule when the rotatable actuator is rotated. The telescopically extending post portion frictionally engages the plunger and pushes the plunger into the capsule, whereby the toothpaste is expelled.

The main body can be formed as an elongated structure having a longitudinal first channel in which the brush is positioned. The main body further includes a longitudinal second channel for receiving the capsule. The capsule includes a reservoir for storing toothpaste, a nozzle orifice for receiving toothpaste into the reservoir, and a cap in which the port and a port orifice is defined. A conduit extends at least partially through the cap between the port and the port orifice.

The cap is coupled to the capsule and configured to pivot between an open position and an engaged, closed position. When the cap is in the open position, the nozzle orifice is exposed and can receive toothpaste for filling the capsule. When the cap is in the engaged position, the nozzle orifice is at least partially aligned with the port orifice to allow toothpaste flow from the capsule, through the nozzle orifice, through the port orifice, through the conduit, and out of the port opening. In one embodiment, the capsule includes a latch that engages the cap in the engaged position. Toothpaste is dispensed from the capsule through the port by manual rotation of the rotatable actuator.

In at least some embodiments, the main body includes a longitudinally extending track formed through a sidewall of the main body along the length of the main body. A knob is secured to the neck of the brush. The knob is placed through the track and is accessible to a user for moving the brush between the stowed position and the deployed position by longitudinal movement of the knob through the track.

The main body can include, at respective opposing longitudinal ends of the longitudinally extending track, a perpendicular first slot and a perpendicular second slot each adjoining the longitudinally extending track. The brush may be selectively locked in the stowed position by placement of the knob from the track into the first slot, and selectively locked in the deployed position by placement of the knob from the track into the second slot. The first slot and second slot may join the track along a common lateral side of the track for intuitive use when locking the brush in either the stowed position or deployed position.

The head of the brush may be sunken into the oral care system when in the stowed position. In another feature, the main body can include an extended brace stabilizer that supports the brush in the deployed position. The brush is positioned in a space defined between the extended brace stabilizer and cap when in the stowed position.

The main body serves as a handle for grasping by a user to manually move the entirety of the oral care system when brushing the user's teeth. The brush may include elongated lower bristles that sever toothpaste when the brush is moved from the stowed position to the deployed position. In yet another feature, the main body can optionally include a floss cavity for storing floss and a slit for dispensing floss from the floss cavity.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate some, but not all, embodiments and features as briefly described below. The summary and detailed descriptions, however, are not limited to only those embodiments and features explicitly illustrated.

DETAILED DESCRIPTIONS

Figure 1A:
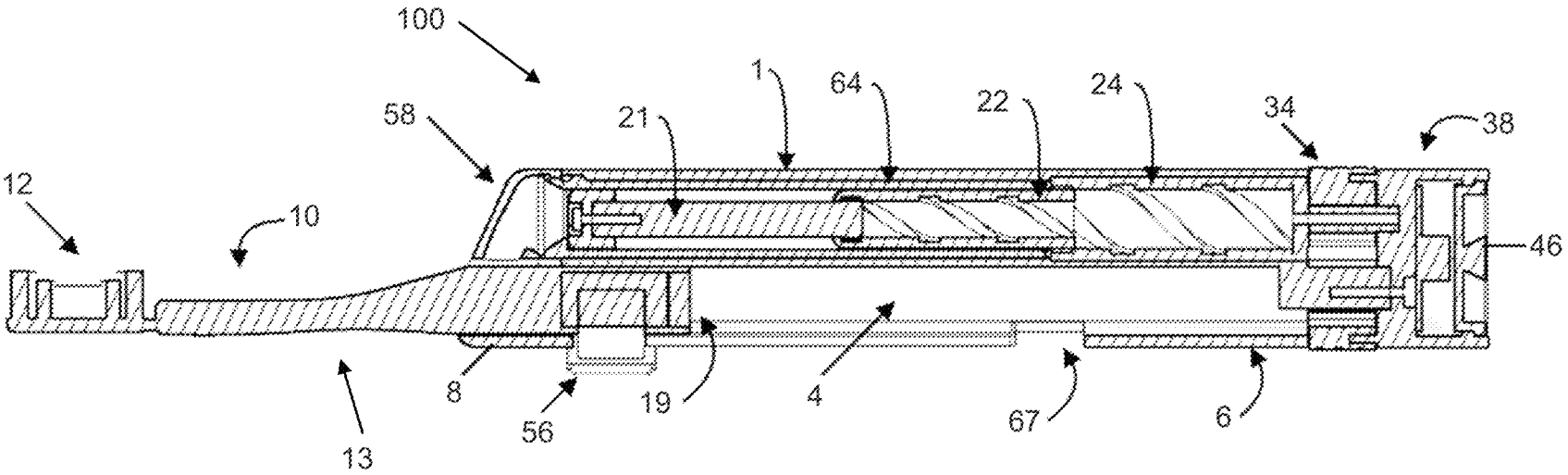
FIG. 1A is a cross-sectional view of an oral care system, according to at least one embodiment, further illustrated in whole or in part in FIGS. 1B-15, the below brief descriptions of which refer to same.

The accompanying drawings are to be considered part of the entire written description. The present invention will now be described more fully hereinafter with reference to the accompanying drawings in which example embodiments of the invention are shown. However, the invention may be embodied in many different forms and should not be construed as limited to the representative embodiments set forth herein. The representative embodiments do not limit the scope of the invention to a manually operated design, and embodiments demonstrating automated and electronic enhancements, including use of photovoltaic technology, are possible. The example embodiments are provided so that this disclosure will be both thorough and complete and will fully convey the scope of the invention and enable one of ordinary skill in the art to make, use, and practice the invention.

Relative terms such as lower or bottom; upper or top; upward, outward, or downward; forward or backward; and vertical or horizontal may be used herein to describe one element's relationship to another element illustrated in the figures. It will be understood that relative terms are intended to encompass different orientations in addition to the orientation depicted in the drawings. By way of example, if a component in the drawings is turned over, elements described as being on the "bottom" of the other elements would then be oriented on "top" of the other elements. Relative terminology, such as "substantially" or "about," describe the specified materials, steps, parameters, or ranges as well as those that do not materially affect the basic and novel characteristics of the claimed inventions as whole (as would be appreciated by one of ordinary skill in the art).

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

According to a first described embodiment, illustrated in whole and in part in various views in FIGS. 1A-15, a manually operated oral care system 100 includes a toothbrush, toothpaste, and floss capsule housed in a single hand-held device. From a port on the device's dispensing capsule, toothpaste is manually expelled by compression onto the bristles of an adjacently positioned toothbrush. Toothpaste is expelled effortlessly by eliminating exposure of toothpaste to the internal components involved in the motion of compression. The toothbrush, with paste, is fully extended and locked in position for brushing. Additionally, the fully extended and locked toothbrush seals access to the toothpaste, which eliminates the need for a cap to keep out air and contaminants. The dispensing capsule may be removed to access a reusable toothpaste capsule reservoir that is conveniently refilled by the consumer once extracted. Floss is housed and dispensed at the distal end of the device and may also be filled and refilled by the consumer.

The main body serves as the central unit that carries interconnected components. The main body consist of a primary channel and a secondary channel adjoined by an interior wall that allows each channel to house components that function independently. The main body consists of a vertical track opening with upper and lower slots. The top of the main body has a partial brace stabilizer that extends distally from the secondary channel. Protruding anchor formations at the base of the main body integrate with the channel interior wall.

A dial actuator consisting of a rail and gear teeth is central to operating components housed within the primary channel of the main body. A floss cavity, interfaced with the dial actuator, consist of a spool post and a floss cavity cap. Floss is manually dispensed and cut from the floss cavity. Click dial dispensing indicators, such as evenly divided raised lines superimposed on the top surface of the actuator, with opposing indentions on the bottom of the main body outer ring (not shown), may be incorporated to help indicate, by sound and sensation, when a sufficient amount of toothpaste has been dispensed.

The brush assembly consists of a head, neck, and actuator components. The head has front facing bristles and may also include a tongue scraper. The neck may have a detachable feature that enables periodic replacement of the head. The neck consists of an elongated body having a broad base that has an actuator housing cavity and an opening located at the bottom of the brush neck. Actuator components consisting of an actuator and an actuator orifice seal is adjoined with the head and neck to complete the brush assembly. The brush assembly is housed in the secondary channel of the main body and is aligned with the main body track. A knob placed through the track engages with the actuator to allow the brush assembly to be extended and retracted for toothpaste application and closing of the port.

The primary channel of the main body functions as the housing for a capsule, a telescopic post, and a plunger. The capsule consists of a reservoir, a cap, and a cap door. The capsule reservoir may be refilled with any brand of toothpaste personal to the consumer's needs. The telescopic post assembly frictionally engages, with and may be adjoined to, the plunger. The telescopic post, having a gear at the distal end, interfaces with the dial gear and is secured to the floss cavity. The dial gear when rotated clockwise engages with the telescopic gear, which engages the telescopic post helices, causing the telescopic posts and plunger to extend and compress toothpaste housed in the capsule through the capsule cap door and onto the bristles of the toothbrush. Rotating the dial gear counterclockwise retracts the telescopic post and plunger to a lowered position.

The oral care system has numerous design features that enhances the oral care experience. Collectively, the conjoined brush assembly and capsule, the telescopic plunger feature, and placement of the dial actuator creates an ergonomically designed oral care system that maximizes space utilization to provide a practical mean to use refillable toothpaste capsules. To reduce the carbon footprint and enhance durability, sustainable practices were incorporated to limit the number of replacement parts. For mobility, a toothbrush cap cover protects the bristles and toothpaste from contaminants while reducing the size of the oral care system to fit conveniently in carrying cases and purses.

Figure 1B:
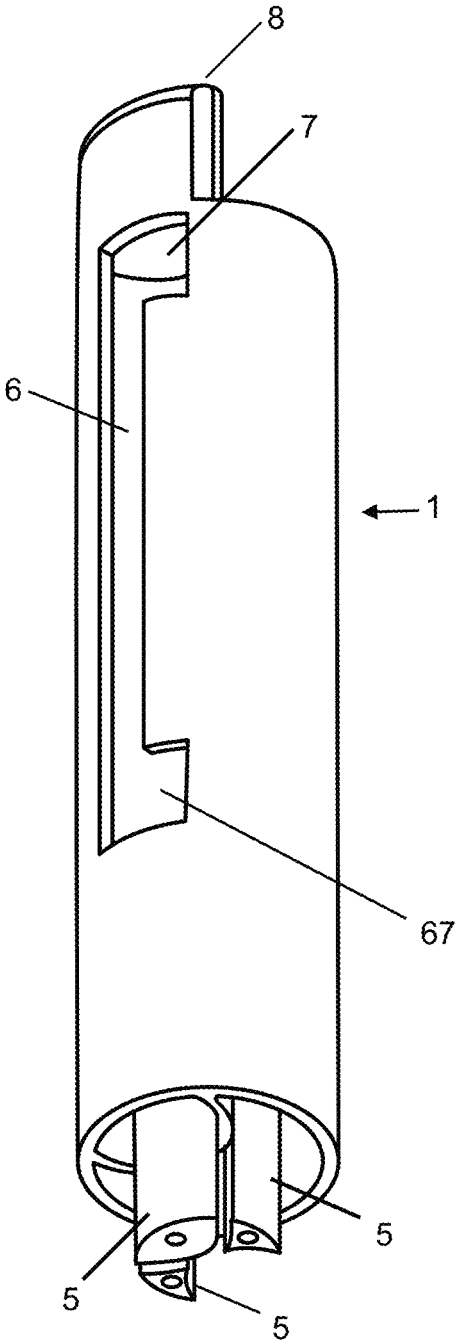
FIG. 1B is a perspective view of the main body.
Figure 1C:
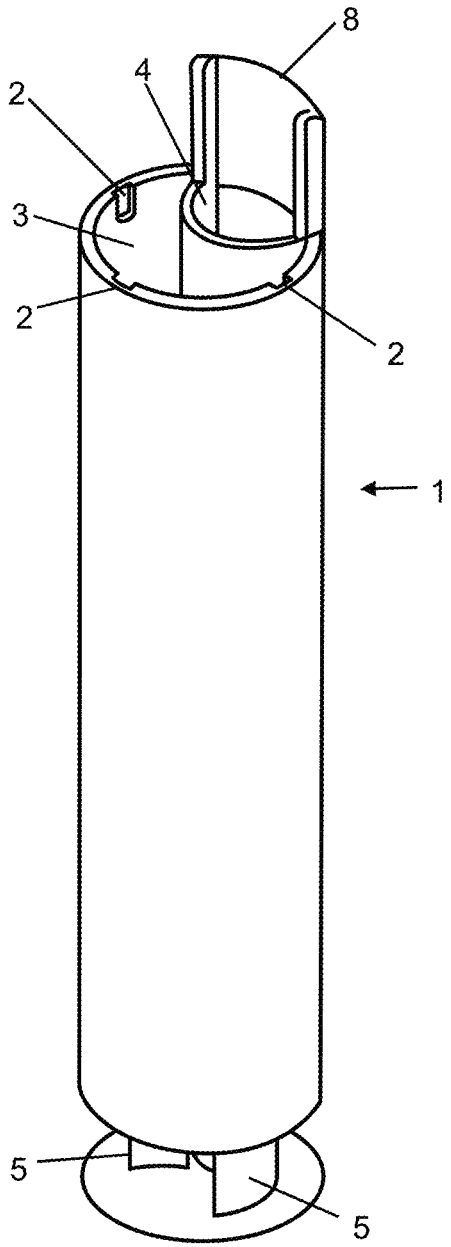
FIG. 1C is a perspective view of the main body rotated around a longitudinal axis relative to FIG. 1B.

Turning to FIGS. 1A-1D, the oral care system includes an elongated main body 1 with a longitudinally extending track 6 formed as a vertical or longitudinal path that extends along the length of the main body. The respective opposing longitudinal ends of the track each adjoin a perpendicular upper slot 7 and a perpendicular lower slot 67. At the top of the main body 1 is an extended brace 8. At the base of the main body 1 are protruding anchor formations 5. The main body 1 includes at least one notch 2, a vertical primary channel 3, and a vertical secondary channel 4, as depicted in FIGS. 1C-1B. The notches 2 are positioned at proportionate distances and extend downward at an equal distance in the interior wall of the primary channel 3.

Figure 1D:
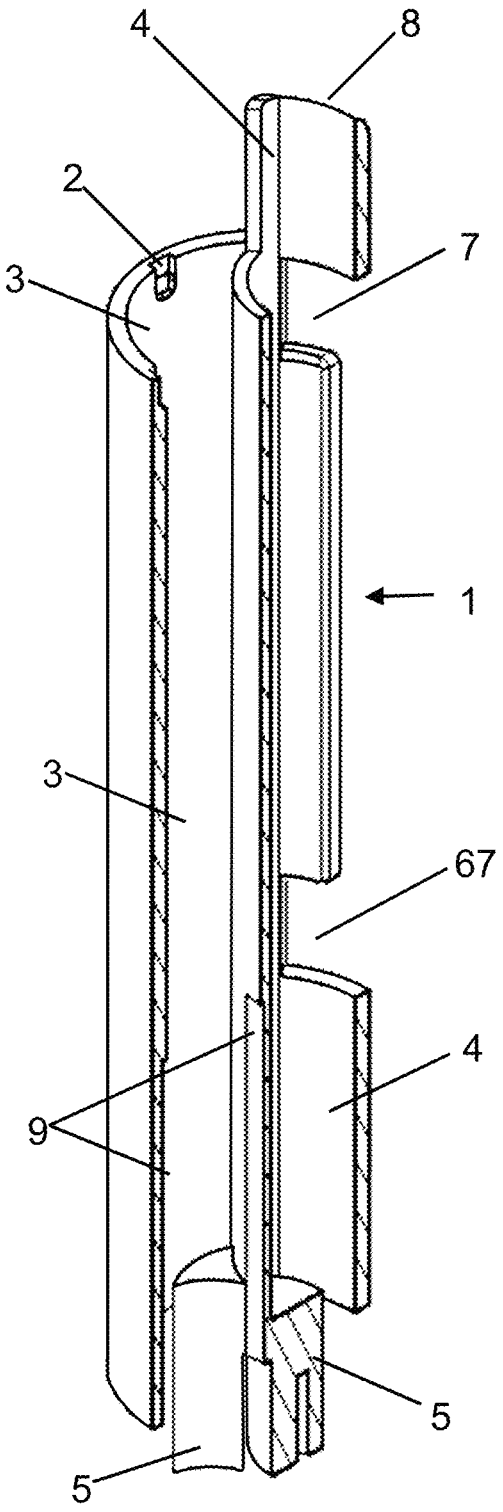
FIG. 1D is a perspective view as in FIG. 1C, shown with portions of the main body in a cross-sectional view.

Referring to FIG. 1C, a perspective view shows the top of the main body 1 illustrated with multiple notches 2, a vertical or longitudinal primary channel 3, and a vertical or longitudinal secondary channel 4. The notches 2 can have approximately equal sizes and dimensions and be positioned at proportionate distances along the circumference of one end of the main body 1. FIG. 1D shows a cross-sectional view of the main body 1 where the primary channel 3 and secondary channel 4 extend the length of the main body 1. The protruding anchor formations 5 are integrated with the inner walls of the primary channel 3 and the secondary channel 4 of the main body 1. An integrated groove 9 is situated on either side of the interior walls of the primary channel 3 of the main body 1.

Figure 2A:
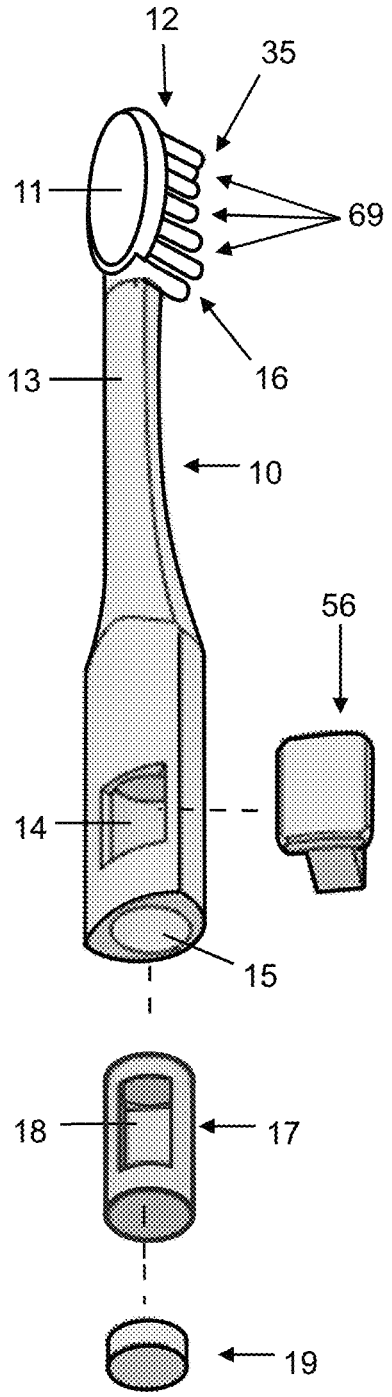
FIG. 2A is an exploded perspective view of the brush head assembly.
Figure 2B:
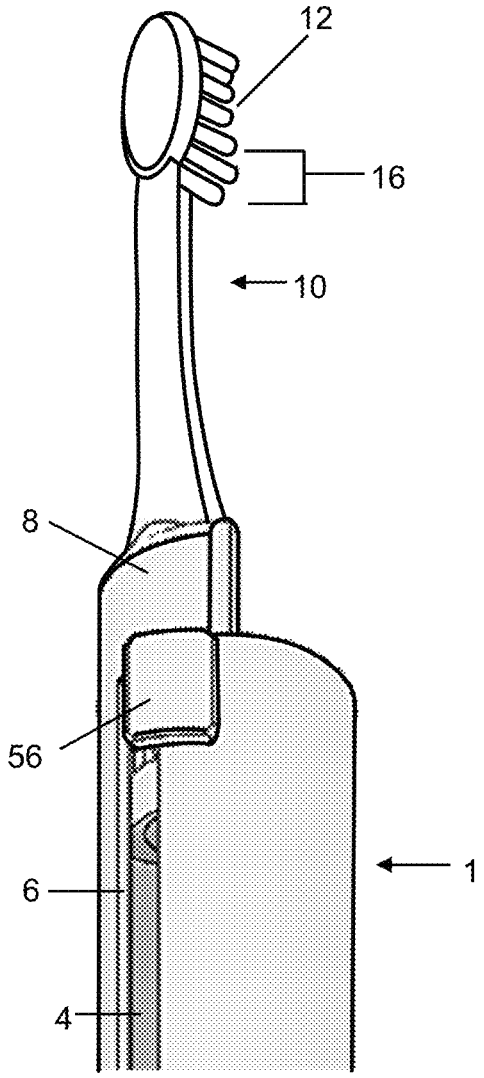
FIG. 2B is a perspective view of the brush head assembly mounted on the main body.

As shown in FIGS. 2A-2B, the oral care system includes a brush 10 having a head 11 with bristles 12, a neck 13 extending from the head 11, an actuator housing 14, and an actuator orifice 15. The bristles 12 are attached at their first ends to the head 11 and extend therefrom to their distal ends 35 opposite the first ends. The distal ends 35 together define a brush bristle surface 69 that serves as a deformable working surface for tooth cleaning when the system is in use. A portion of the main body 1, for example, between the neck 13 and dial actuator 34, serves as a handle for grasping by a user to manually move the entirety of the oral care system, and the brush 10 therewith, when brushing his or her teeth.

A tongue scraper (not shown) can be positioned on the back of the head 11. Below the bristles 12 are elongated lower bristles 16. The neck 13 can be in two parts (not shown) to create a detachable head from the brush 10 for wear replacement. A manually operated actuator 17 consisting of a knob housing 18 is positioned in the actuator housing 14 through the actuator orifice 15 so that the outline of the knob housing 18 aligns with the outline of the actuator housing 14. The actuator 17 is permanently secured in the actuator housing 14 with an actuator orifice seal 19. The preassemble brush 10 is inserted into the top of the secondary channel 4 of the main body 1 with the knob housing 18 accessible through the track 6 of the main body 1. A knob 56 is permanently affixed into the knob housing 18 for manually operating the actuator, for example by use of a user's thumb, to move the brush 10 from a stowed position (FIGS. 13A-13B) to a deployed position (FIG. 1A, FIG. 14), and return the brush 10 to the stowed position by opposite manual movement of the knob 56.

Figure 3A:
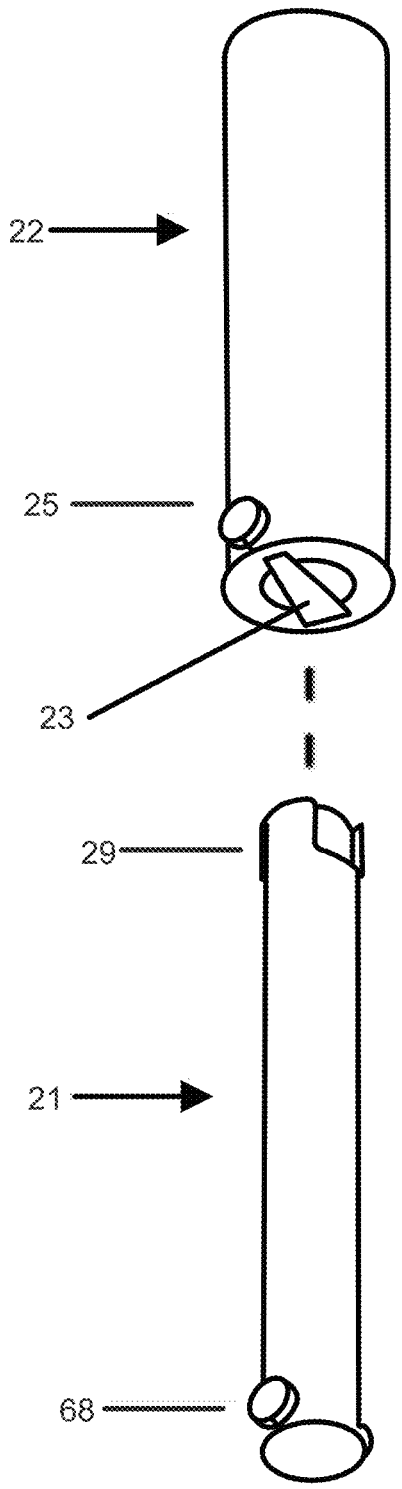
FIG. 3A is an exploded perspective view of inner components of the telescoping toothpaste dispensing device.
Figure 3B:
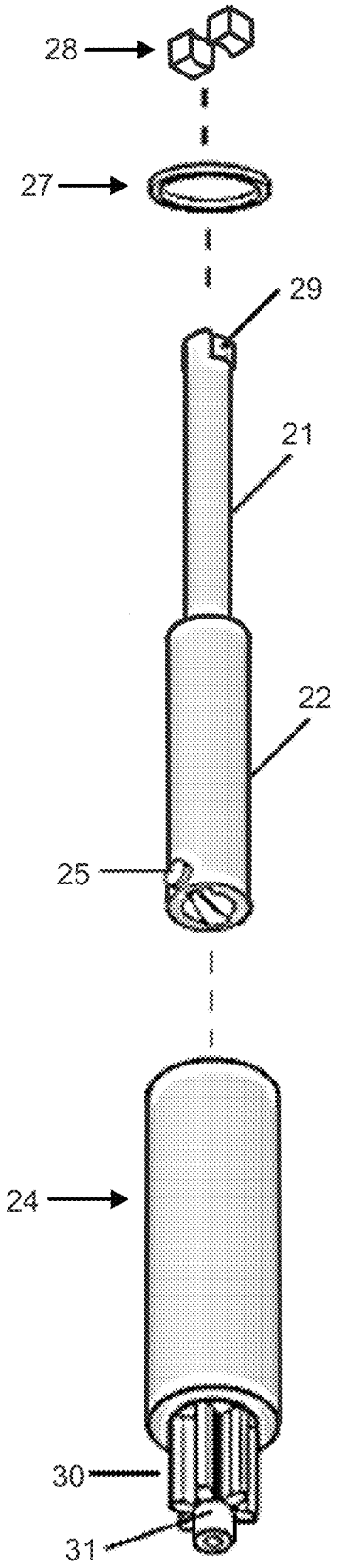
FIG. 3B is an exploded perspective view of more inner components of the telescoping toothpaste dispensing device.
Figure 3C:
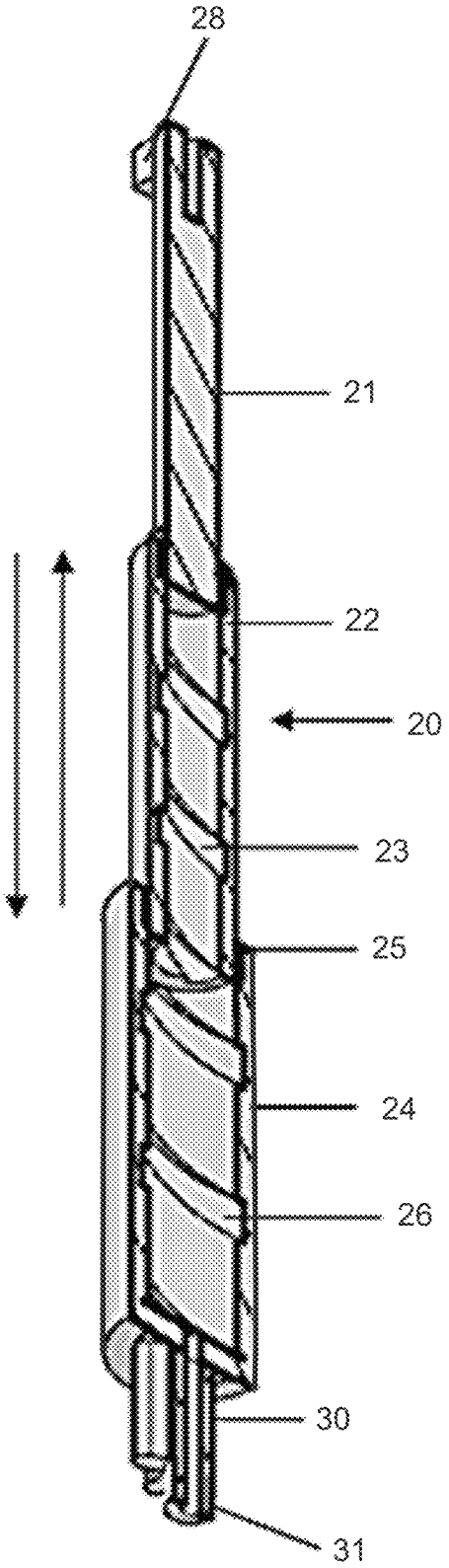
FIG. 3C is a cross-sectional perspective view of inner components of the telescoping toothpaste dispensing device.

Pre-assembly and assembly stages of a telescopic post 20 are shown in FIGS. 3A-3C. The solid inner post 21 inserts into the bottom of the hollow middle post 22 where the inner post arms 68 align with the middle post helices 23. The middle post helices 23 terminate at a certain position prior to the terminal end of the top of the middle post 22. The combined middle post 22 and inner post 21 are inserted into the main post 24 with the middle post arms 25 entering the top end of the main post 24 to align the middle post arms 25 with the main post helices 26. The ring 27 inserts over the top of the combined inner post 21, middle post 22, and main post 24, while permanently affixed to the top of the main post 24 to cover the entrance to the main post helices 26 and prevent detachment of all posts. Locking components 28 are permanently affixed to the inner post recesses 29 (refer to FIG. 3B).

An integrated main post gear 30 is situated at the base of the main post 24. The main post support 31 is situated at the base of the main post gear 30. The main post support is fixed or coupled to the main post gear 30 and the main post 24 so that when the rotating actuator 34 rotates the main post gear 30, the main post 24 also rotates. Rotation of the main post 24 causes the middle post 22 to begin telescopic translation between a retracted position and an extended position. The middle post arms 25 engage the main post helices 26 causing the middle post 22 and the inner post 21 to rotate and translate upward or downward. That is, after the middle post 22 has been fully extended by the main post 24, the middle post 22 then engages the inner post arms 68 to rotate the inner post 21 upward Significantly, the brush assembly is extended between the stowed and deployed positions using an actuator that is different than the actuator used to expel toothpaste. That is, the brush is moved using a separate actuator than the actuator used to actuate the plunger 32 and expel toothpaste from the dispensing cap 58. Actuating the brush and the expulsion of toothpaste utilizing the same actuator would not permit the oral care system to effectively place toothpaste on a brush head if the toothpaste expulsion is interrupted by, for instance, an air bubble in the toothpaste supply. By using separate actuators, the current system allows users to completely and effectively dispense a desired amount of toothpaste before actuating the brush assembly.

Figure 4:
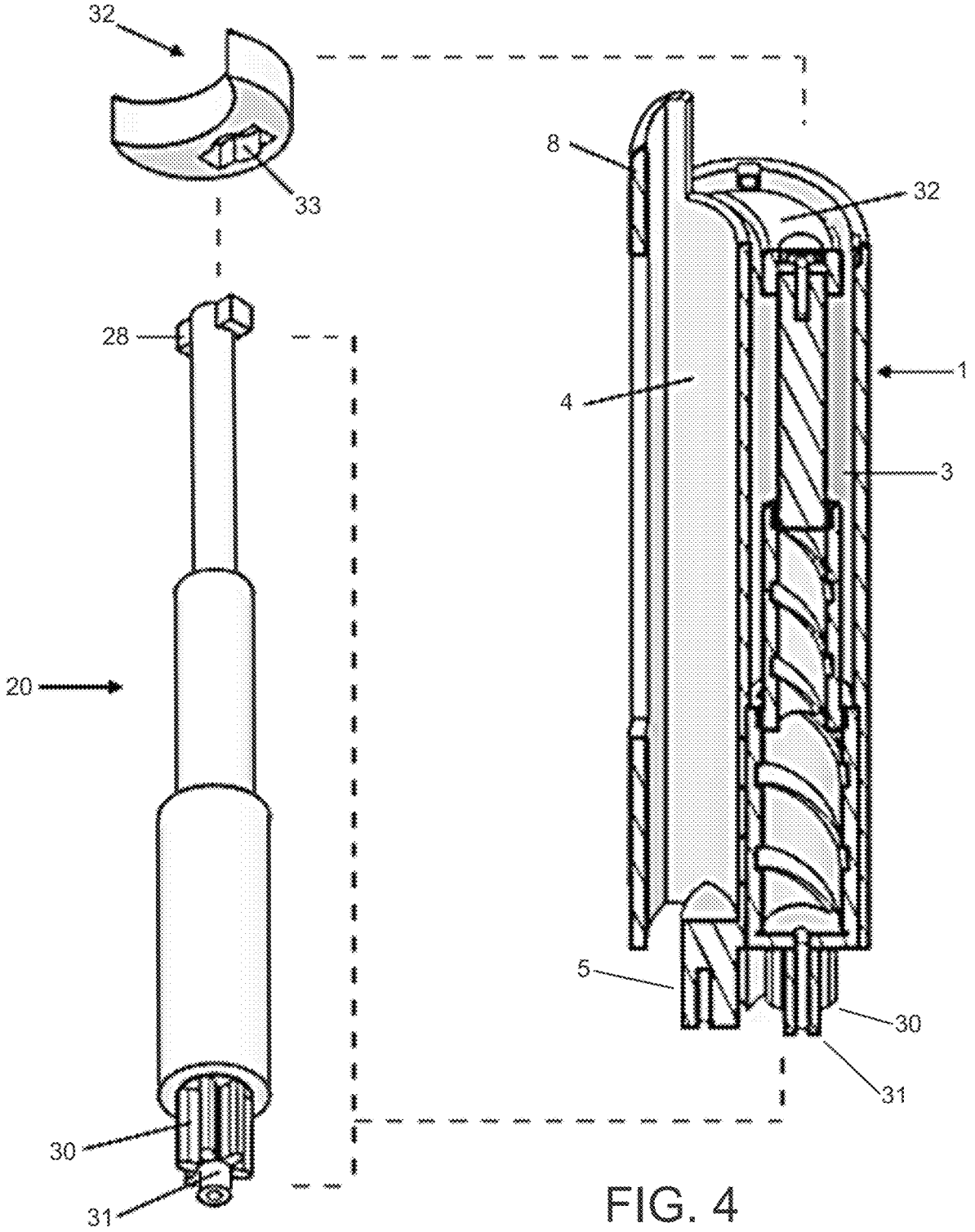
FIG. 4 shows components of the telescoping toothpaste dispensing apparatus in solid and cross-sectional perspective views.

FIG. 4 shows perspective and cross-sectional views that illustrate the integration of the telescopic post 20 with the main body 1. The top of the telescopic post 20 is inserted through the bottom of the primary channel 3 of the main body 1, which has integrated grooves 9 (refer to FIG. 1D) that restrict the vertical movement of the main post 24 (refer to FIG. 3B-3C). The plunger 32 is inserted through the top of the primary channel 3 of the main body 1 and is affixed to the top of the telescopic post 20 by aligning the plunger keyhole 33 to the locking components 28 of the telescopic post 20. The plunger 32 can include a rubber seal to mitigate toothpaste escaping from the capsule. The main post gear 30, and the main post support 31 of the telescopic post 20 protrude beyond the main body 1 and are situated adjacent to the anchor formations 5 of the main body 1.

Figure 5B:
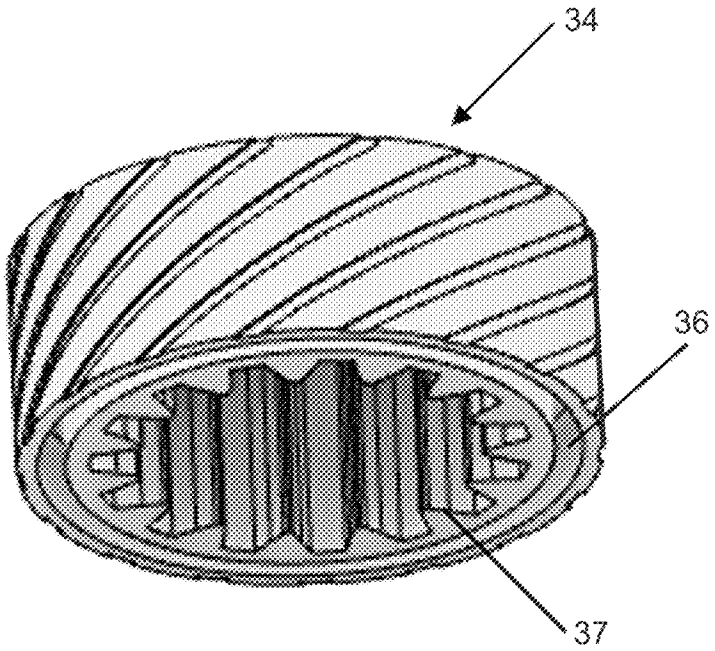
FIG. 5B is another perspective view of the dial actuator.
Figure 5A:
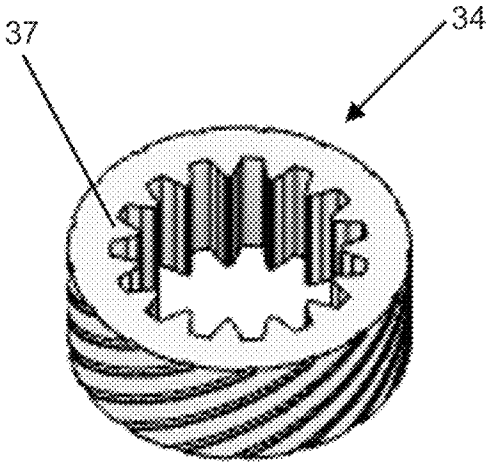
FIG. 5A is a perspective view of the dial actuator for driving the telescoping toothpaste dispensing apparatus.

A dial actuator 34 is depicted in FIG. 5A and has internal gear teeth 37 that extend the entire length of the dial actuator 34. The top of the dial actuator 34 is smooth. Referring to FIG. 5B, a perspective view shows the bottom of the dial actuator 34. An integrated track 36 runs around the perimeter of the gear teeth 37 and extends upward before terminating at a certain distance. In some embodiments, click dial dispensing indicators, such as evenly divided raised lines superimposed on the top surface of the actuator, with opposing indentions on the bottom of the main body outer ring (not shown), may be incorporated to help indicate, by sound and sensation, when a sufficient amount of toothpaste has been dispensed.

Figure 6A:
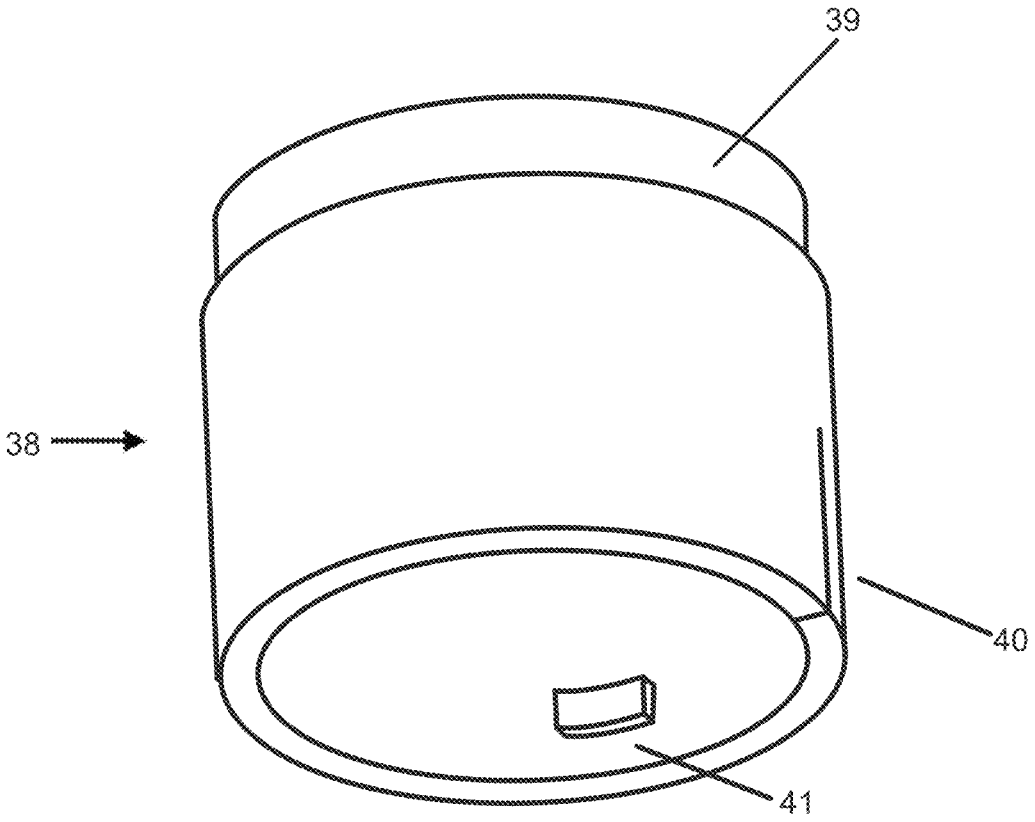
FIG. 6A is a perspective view of the floss cavity.
Figure 6B:
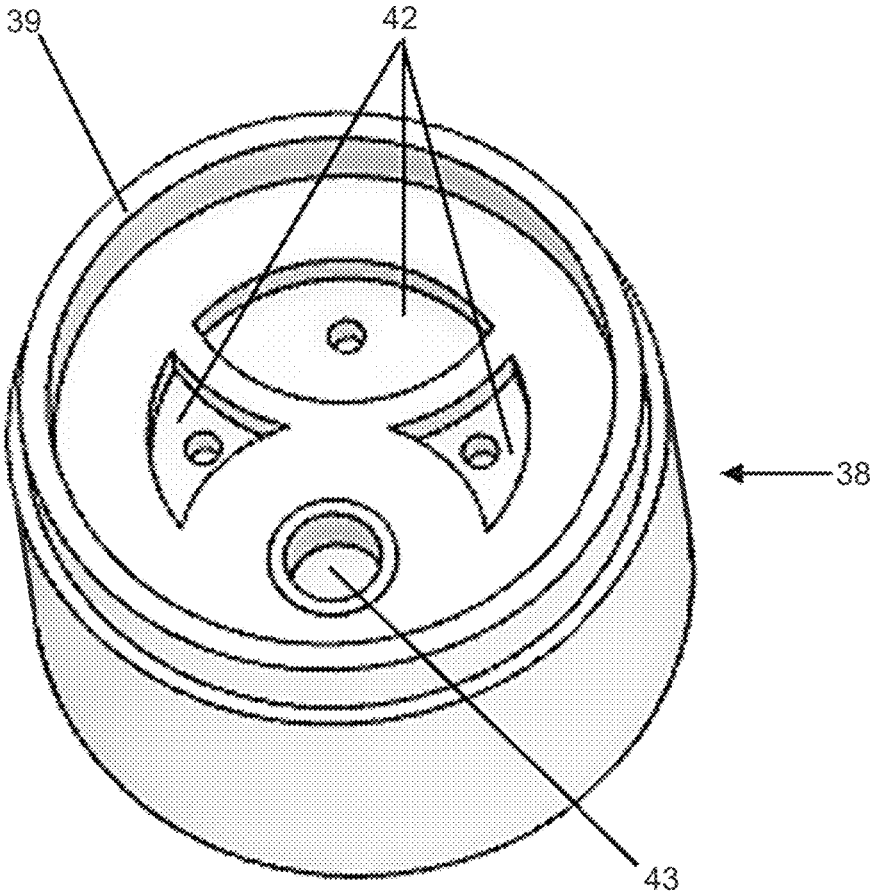
FIG. 6B is another perspective view of the floss cavity

The oral care system can include a circular floss cavity 38, as shown in FIG. 6A. The top of the floss cavity 38 is indented to form a rail 39. A floss slit 40 is positioned at the base of the floss cavity 38 that extends vertically a certain distance. The floss cavity 38 has a hollow opening at the bottom end with an interior latch 41 on either side. Referring to FIG. 6B, a perspective view shows the top of the floss cavity 38 having a recessed surface consisting of anchor formation recesses 42. The main post support recess 43 is located adjacent the anchor formation recesses 42.

Figure 7A:
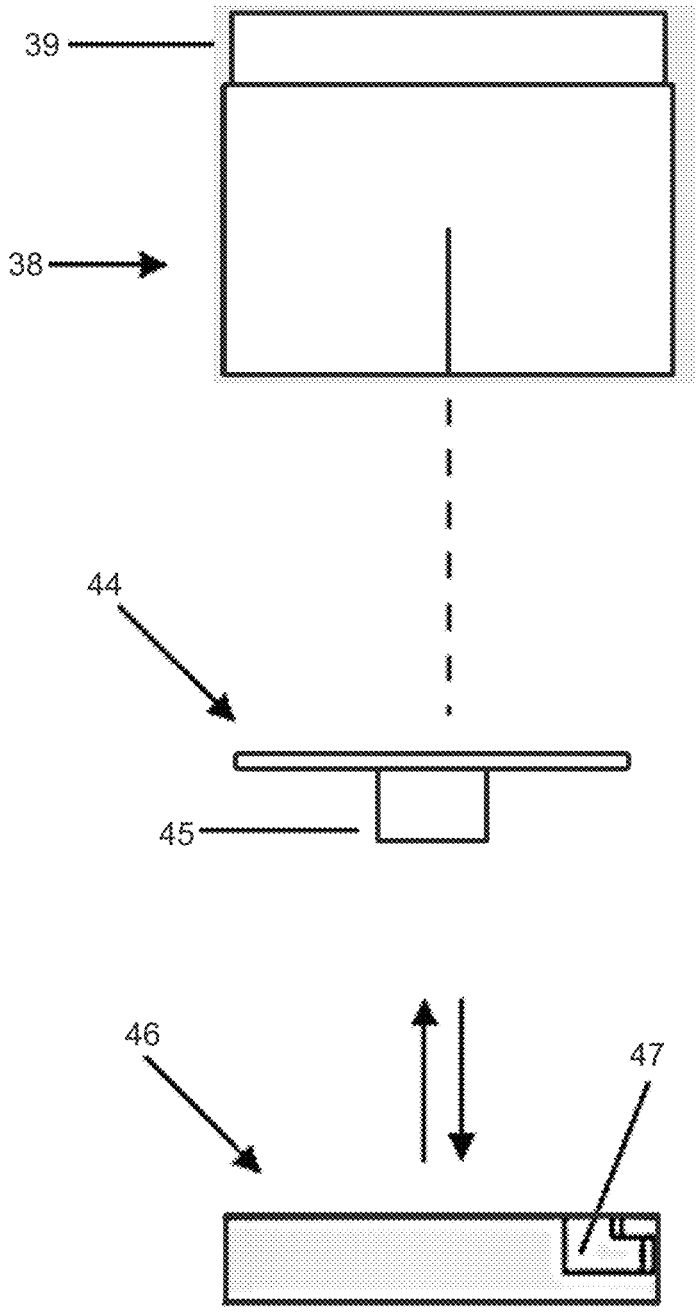
FIG. 7A is an exploded elevation view of the floss cavity and components thereof.
Figure 7B:
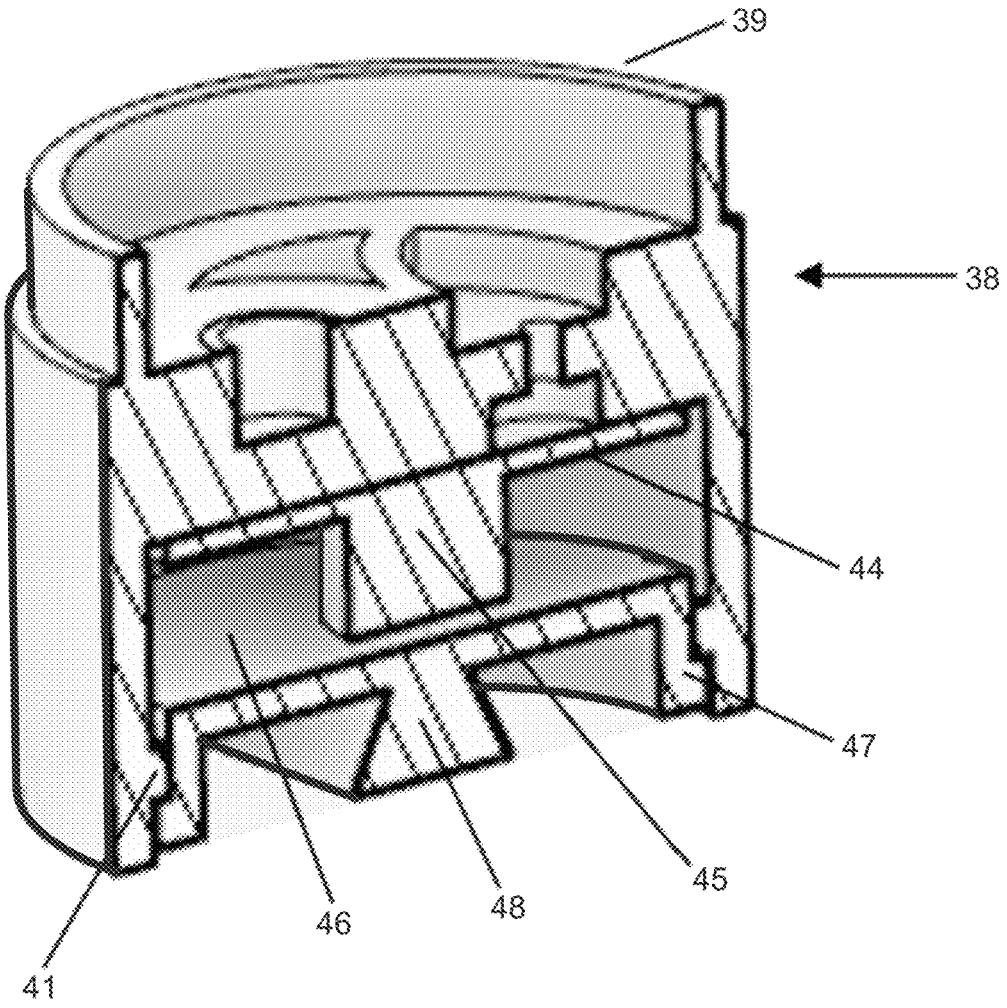
FIG. 7B is a cross-sectional assembled view of the floss cavity and components thereof.
Figure 8:
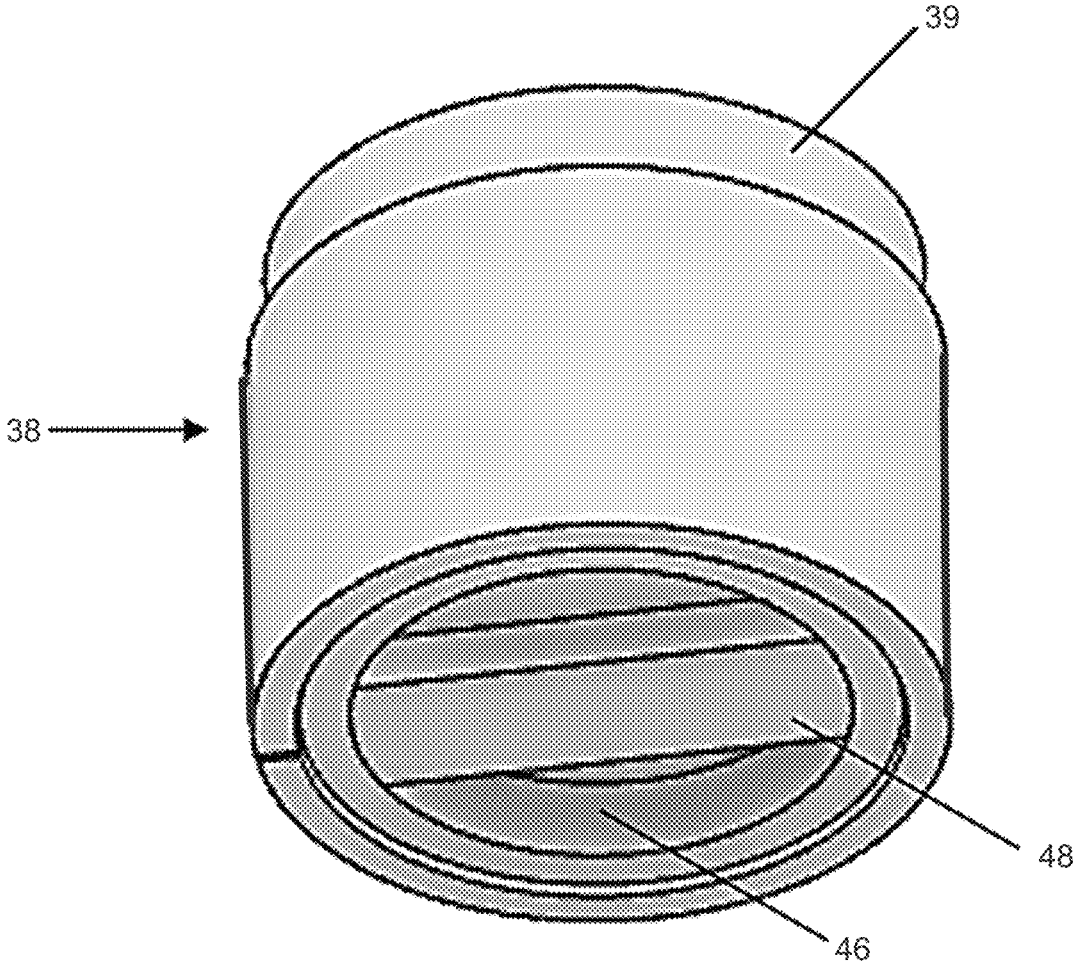
FIG. 8 is a view of the assembled floss cavity showing the cap thereof.

Pre-assembled and assembled stages of the floss cavity 38 are shown in FIGS. 7A-7B. A floss cavity seal 44 with a spool post 45 can be permanently affixed to the interior ceiling of the floss cavity 38. A floss cavity cap 46 has a locking notch 47 on either side that engages with the interior latch 41 on either side of the floss cavity 38 (refer to FIG. 6A). Using the floss cavity cap grip 48, the floss cavity cap 46 can be attached and detached to access the spool post 45. Referring to FIG. 8, a perspective view shows the floss cavity 38 with the floss cavity cap 46 attached exposing the floss cavity cap grip 48. A floss cutter (not shown) can be positioned on the external surface of the floss cavity 38.

Figure 9A:
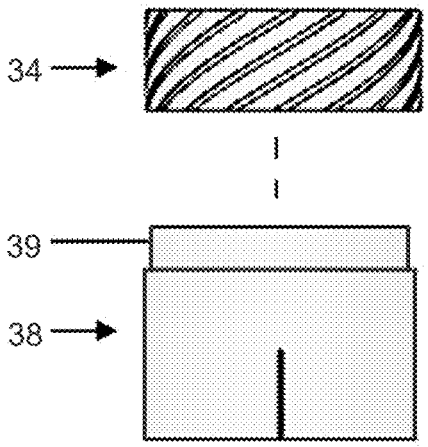
FIG. 9A is an exploded elevation view of the floss cavity and dial actuator.
Figure 9B:
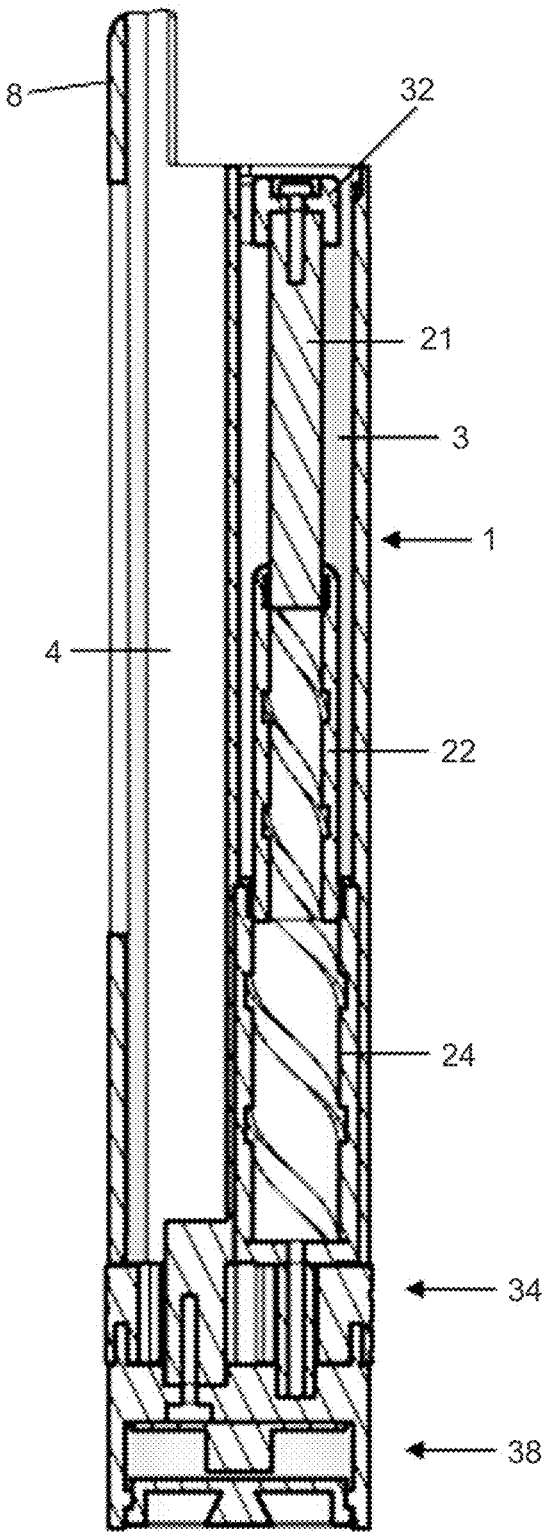
FIG. 9B is a cross-sectional elevation view of many components of the oral care system.

FIG. 9A shows an elevation view of the dial actuator 34 and the floss cavity 38 before assembly. FIG. 9B shows across-sectional view of the dial actuator 34 and the floss cavity 38 both joined with the main body 1. The bottom of the dial actuator 34 and integrated track 36 (refer to FIG. 5B) engage with the top of the floss cavity 38 an indented rail 39 (shown in FIGS. 6A and 6B). The engaged components are joined to the main body 1 by meshing the internal gear teeth 37 (refer to FIG. 5A) with the main post gear 30 (see FIG. 4). The top of the dial actuator 34 is flush with the bottom end of the main body 1. The anchor formations 5 (refer to FIGS. 1B, 1C, and 1D) and the main post support 31 (see FIG. 4) are aligned with the anchor formation recesses 42 and the main post support recess 43 (refer to FIG. 6B) respectively. The anchor formations 5 are permanently affixed to the anchor formation recesses 42. Once assembly is complete, the dial actuator 34 can be rotated clockwise and counterclockwise. The strategic placement of the dial actuator 34 improves the ergonomic design of the main body 1.

Figure 10A:
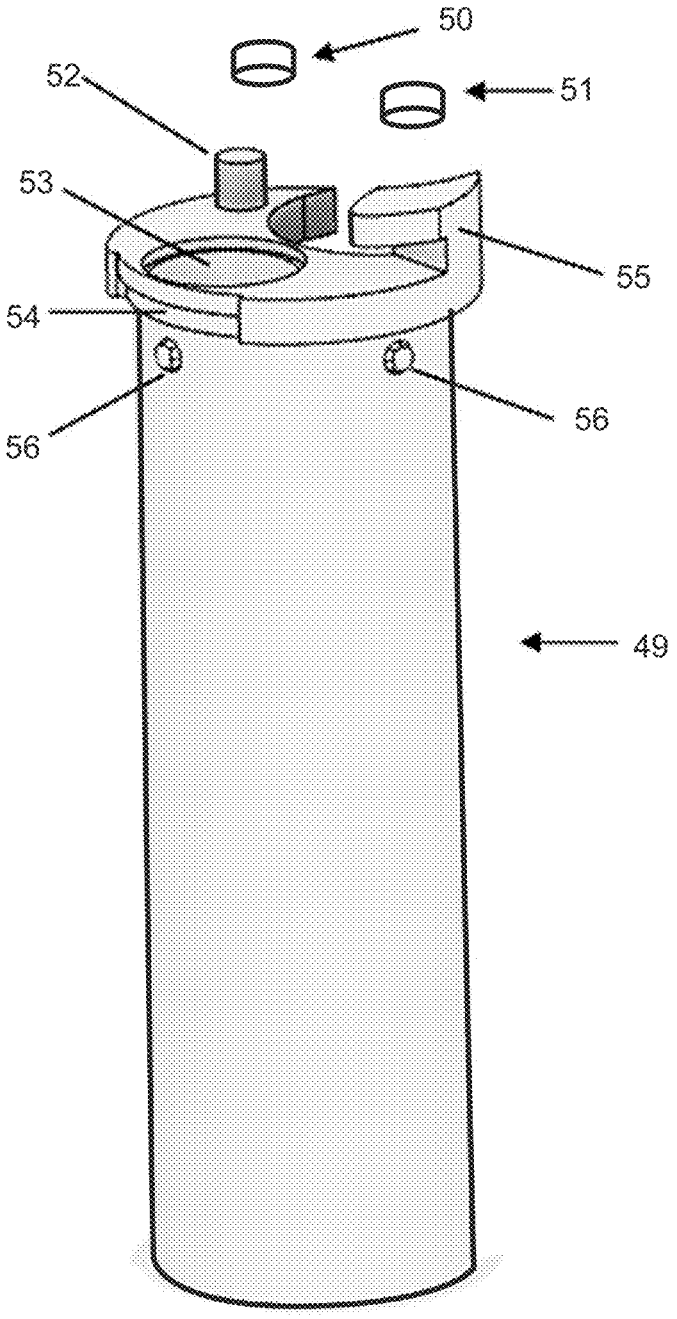
FIG. 10A is a perspective view of the refillable toothpaste capsule.
Figure 10B:
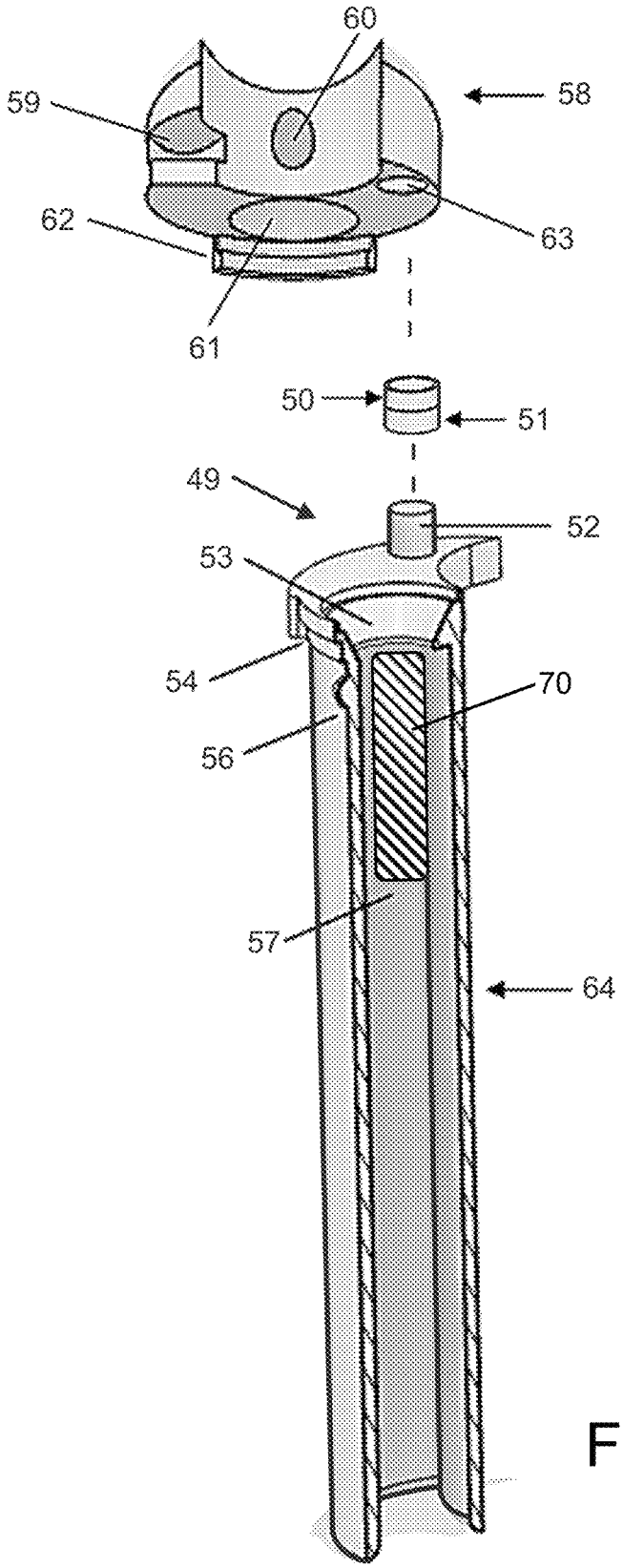
FIG. 10B is an exploded perspective view of the refillable toothpaste capsule shown in part in cross-sectional view.

FIG. 10A shows a perspective view of a capsule base 49, an upper dowel fastener 50, and a lower dowel fastener 51. The capsule base 49 includes a dowel post 52, a nozzle orifice 53, a gate frame 54, and a capsule cap latch 55 with evenly spaced knobs 56 located near the top of the capsule base 49. As depicted in FIG. 10B, a capsule reservoir 57 extends from the base of the capsule base 49 to the nozzle orifice 53. Additionally, the cross-sectional view of FIG. 10B shows the integration of the cap 58 with the capsule base 49. The cap 58 is comprised of a cap seat 59, a port 60, a port orifice 61, a cap gate 62, and a dowel socket 63. A cross slit silicone dispensing valve (not shown) may be positioned at the aperture of the port 60 as a seal protector. During assembly, the lower dowel fastener 51 is placed over the dowel post 52. The upper dowel fastener 50 is permanently affixed to the dowel post 52 over the lower dowel fastener 51. The cap 58 is assembled to the capsule base 49 by fitting the dowel socket 63 over the upper dowel fastener 50 and the lower dowel fastener 51 with the dowel socket 63 permanently affixed to the lower dowel fastener 51.

Figure 11A:
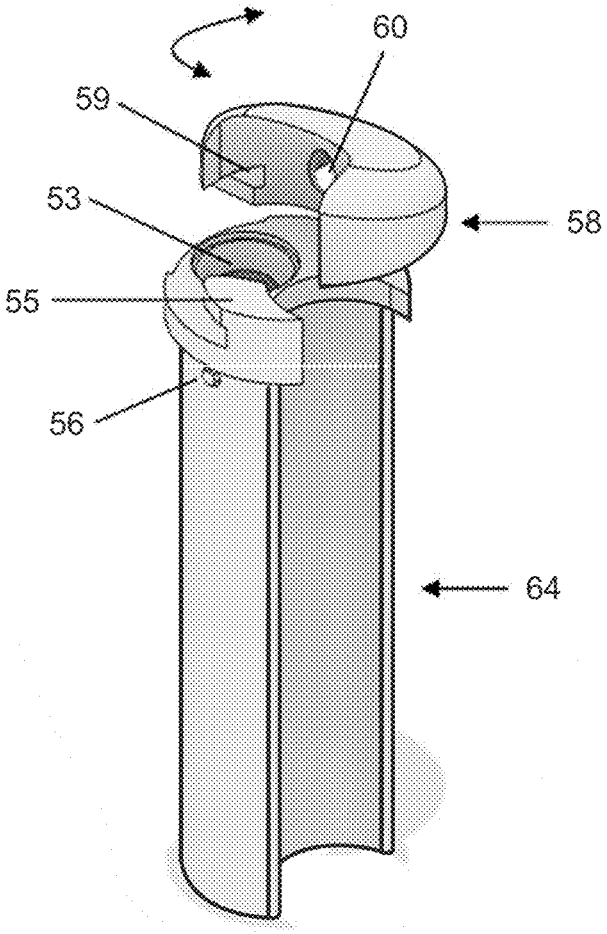
FIG. 11A is a perspective view of the refillable toothpaste capsule showing the operation of the latching cap.

Referring to FIG. 11A, a perspective view shows the components illustrated in FIG. 10A and FIG. 10B collectively become the capsule 64. The cap 58 pivots to engage the capsule cap latch 55 with the cap seat 59. When the capsule cap latch 55 is engaged with the cap seat 59, the nozzle orifice 53 is not accessible. When the capsule cap latch 55 is disengaged with the cap seat 59, the nozzle orifice 53 is accessible.

Figure 11B:
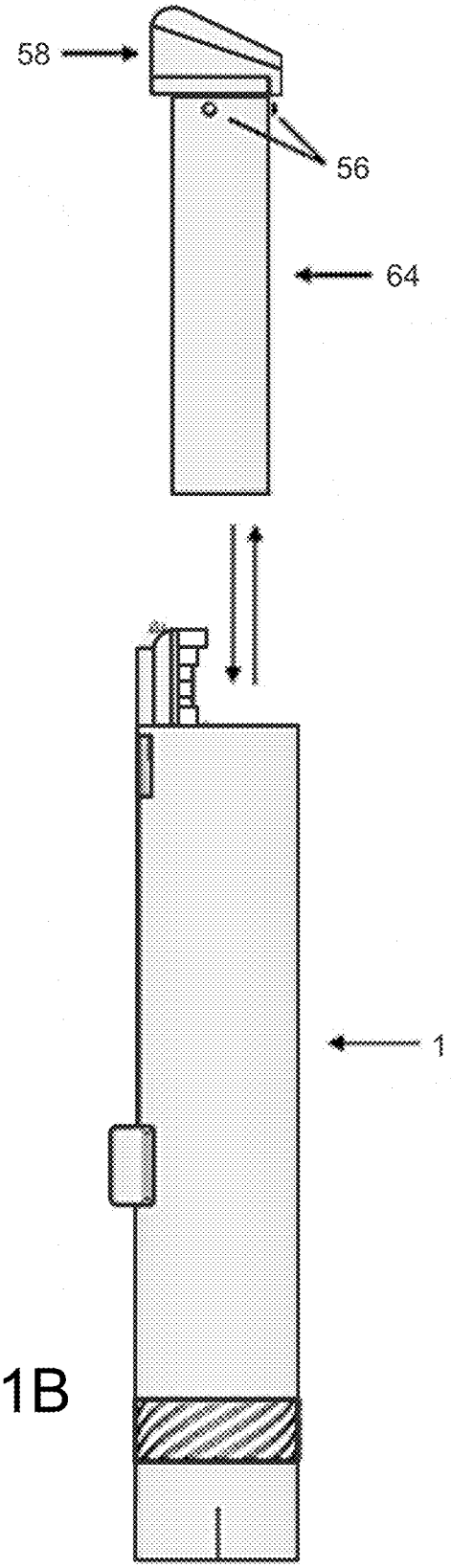
FIG. 11B is an elevation view representing loading of the toothpaste capsule into the main body of the oral care system.

Referring to FIG. 11B, an elevation view shows the combining of the capsule 64 and the main body 1. The bottom of the capsule 64 is inserted into the top of the main body 1 through the primary channel 3 (refer to FIG. 1D). The integrated knobs 56 of the capsule 64 align with matching notches 2 in the primary channel 3 (refer to FIG. 1D) allowing the capsule 64 to be fastened and unfastened to the main body 1. An ergonomic design of the main body 1 is achieved by compacting components where the placement of the capsule 64 in the primary channel 3 (refer to FIG. 1D) abuts the brush 10 in the secondary channel 4 (refer to FIG. 2B and FIG. 13A).

Figure 12A:
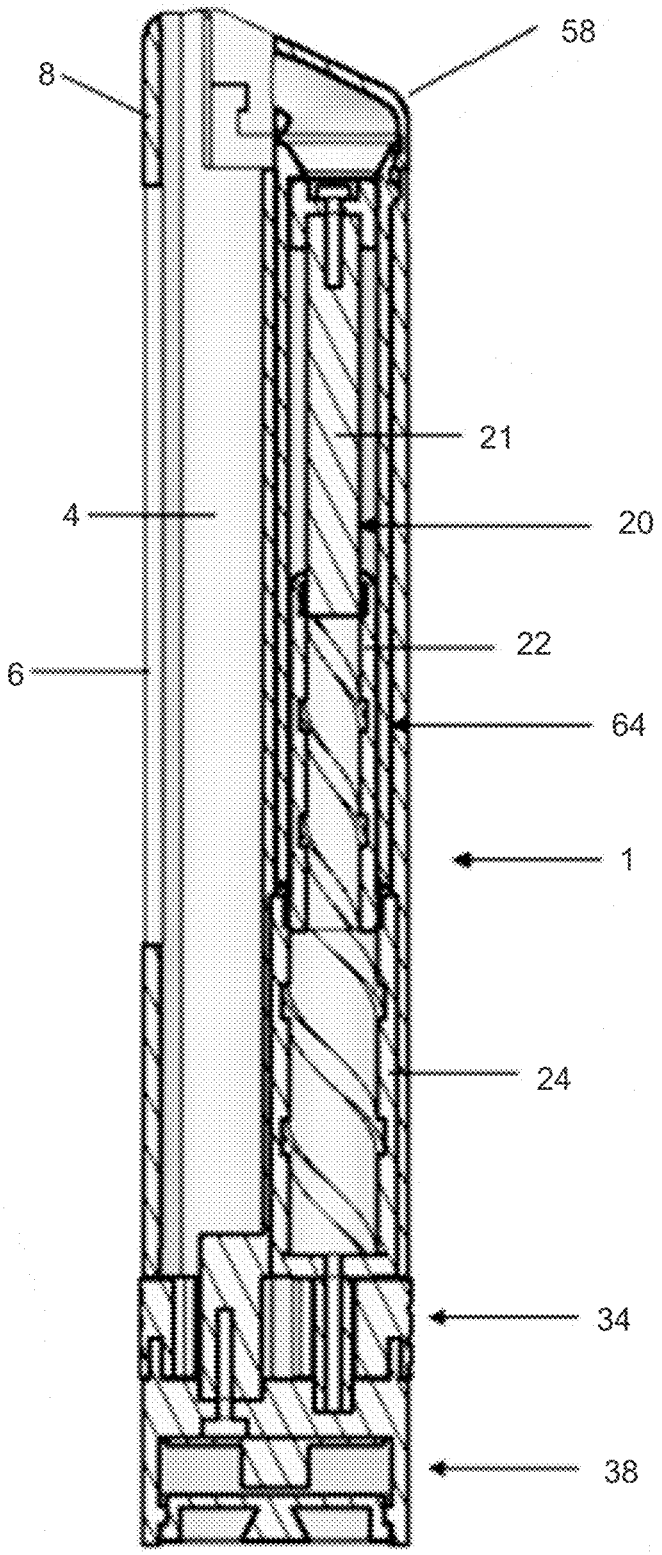
FIG. 12A is a perspective view of the toothpaste capsule installed into the main body of the oral care system, shown with the telescoping dispensing device extended corresponding to depletion of the toothpaste capsule.
Figure 12B:
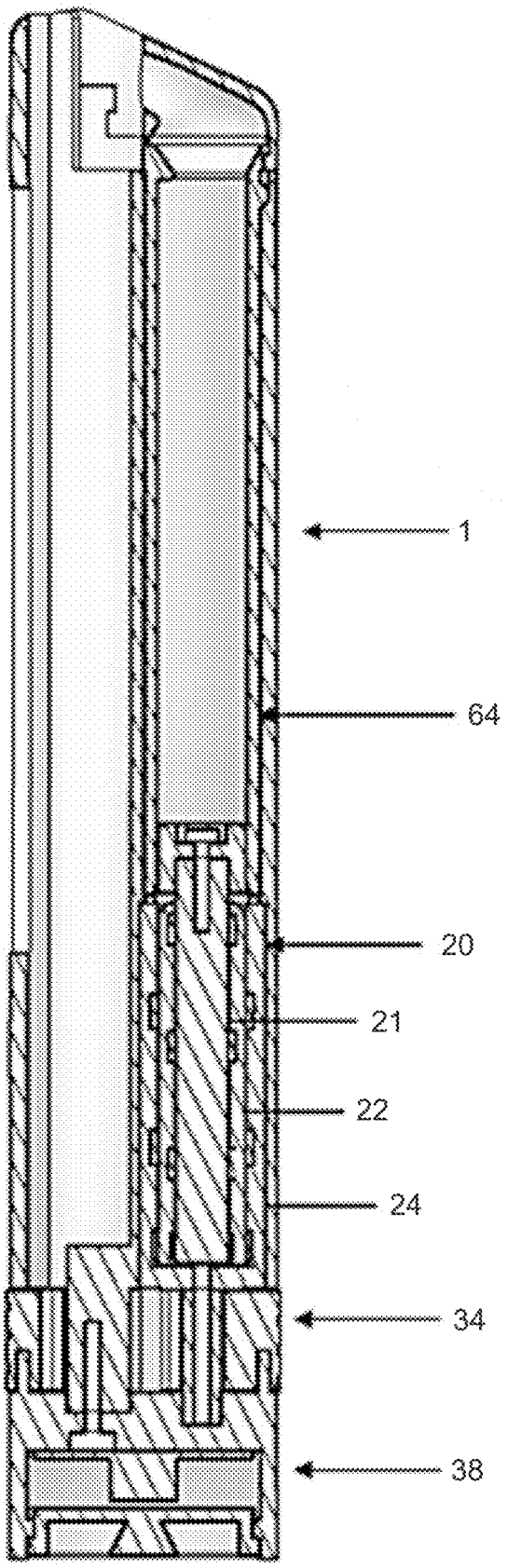
FIG. 12B is a perspective view of the capsule install as in FIG. 12A, shown with the telescoping dispensing device withdrawn corresponding to replenished toothpaste capsule.
Figure 13A:
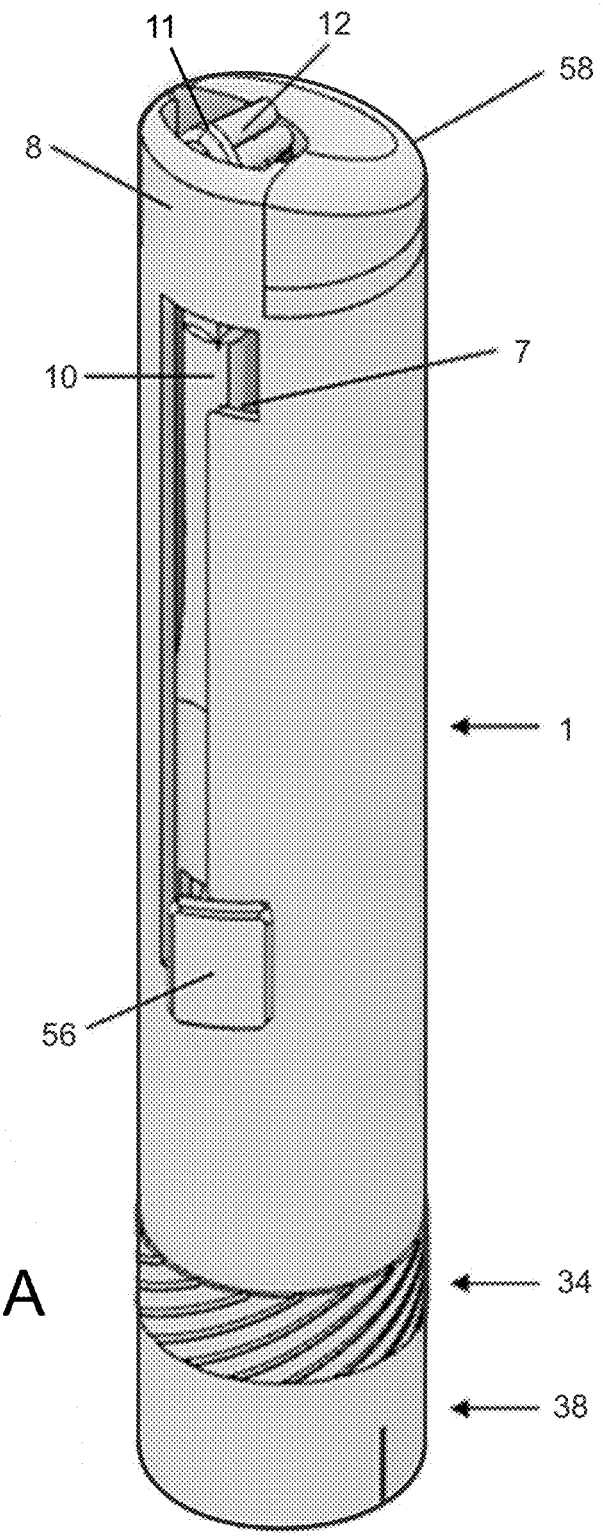
FIG. 13A is a perspective view of the assembled oral care system of FIG. 1A, with the toothbrush in its stowed position.
Figure 13B:
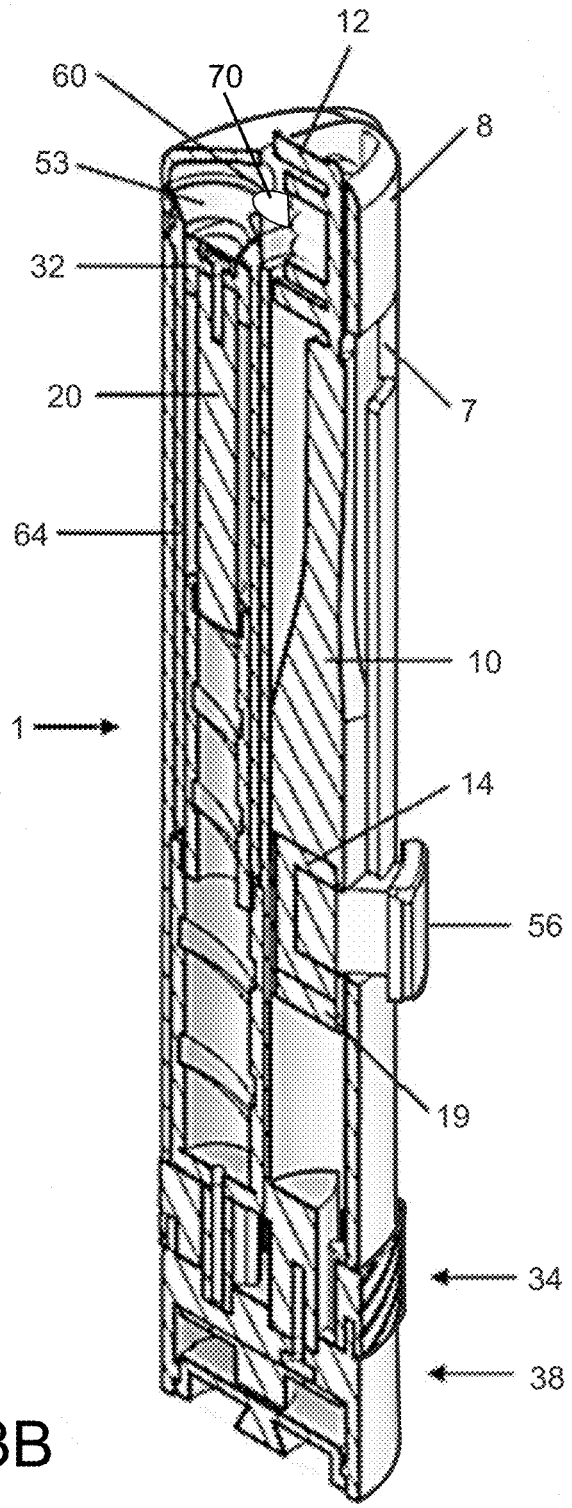
FIG. 13B is a cross-sectional perspective view of the oral care system as in FIG. 13A, with the toothbrush in its stowed position.

Referring to FIGS. 12A-12B, cross-sectional views show the capsule 64, the telescopic post 20 (also refer to FIG. 3C), and the manually rotated dial actuator 34 interconnected with the main body 1. One view shows the telescopic post 20 fully extended within the capsule 64. A second view shows a retracted telescopic post 20 within the capsule 64. Rotating the dial actuator 34 clockwise and counterclockwise extends the telescopic post 20 thereby engaging the capsule 64 to dispense toothpaste onto the bristles 12 of the brush 10 in the stowed position (FIGS. 13A-13B). The capsule 64, the cap 58, and the dial actuator 34 define, in cooperation with the main body 1, a manually operated toothpaste dispensing apparatus by which toothpaste 70 (FIG. 13B) is placed directly onto the brush bristle surface 69 at the distal ends 35 of the bristles 12 (refer to FIGS. 2A-2B). This advantageously conserves toothpaste and minimizes deep saturation of the bristles 12 at their first ends attached to the head 11 serving both aesthetic and sanitary purposes by minimizing accumulation between uses. The compact design of the telescopic post 20 and interconnection with the capsule 64 maximizes space utilization while facilitating an ergonomically designed main body 1.

Turning to FIGS. 13A-13B, perspective and cross-sectional views show the interconnection of various components and describes the function of dispensing toothpaste. The brush 10, housed in the secondary channel 4 (refer to FIG. 1C, FIG. 1D, and FIG. 2B), is locked in the down position by the placement of the knob 56 in the perpendicular lower slot 67 of the longitudinally extending track 6 (refer to FIG. 1B). The aforementioned placement of the brush 10 aligns the bristles 12 with the port 60 (refer to FIG. 10B). Toothpaste 70 contained in the capsule reservoir 57 (refer to FIG. 10A, 10B, and FIG. 11A) is compressed and dispensed through the capsule 64 when the dial actuator 34 is manually rotated clockwise to extend the telescopic post 20 and the plunger 32. Toothpaste, compressed by the extended plunger 32, is expelled through the nozzle orifice 53 and port 60 onto the bristles 12 (FIG. 13B).

A toothbrush cap cover may be provided to protect the bristles 12, the port 60 (refer to FIG. 10B), and toothpaste from contaminants. As shown in FIG. 13A, the head 11 of the brush 10 is sunken into the oral care system upon reaching the stowed position. In particular, the brush 10 is positioned in a space defined between the extended brace stabilizer 8 and the cap 58 when in the stowed position.

Figure 14:
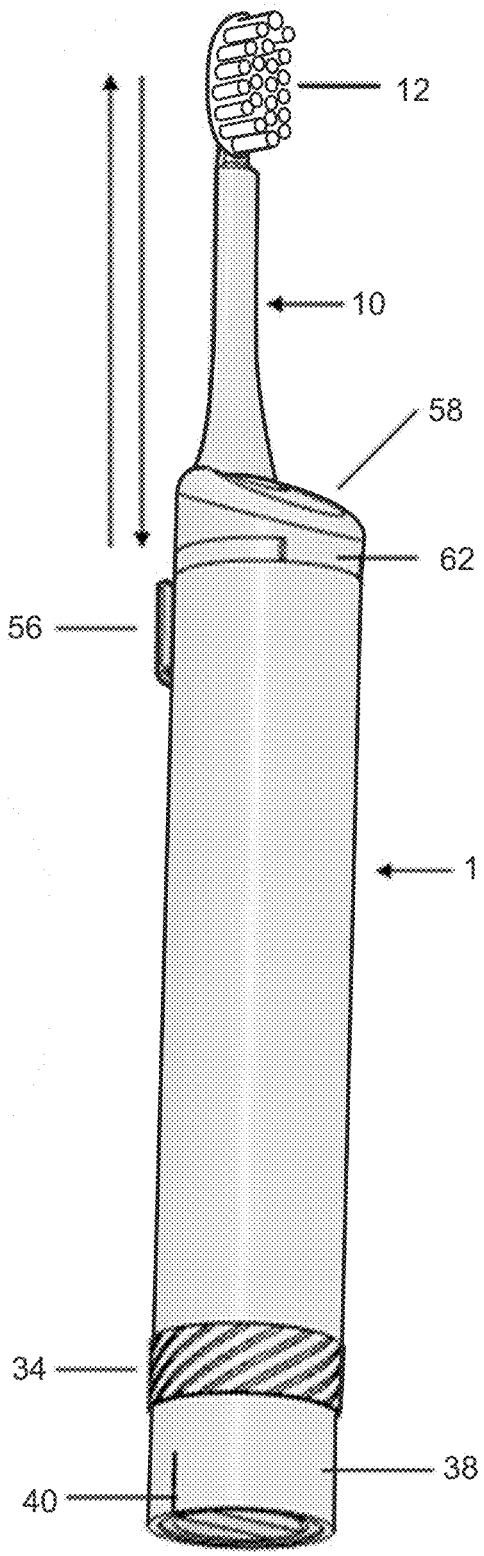
FIG. 14 is a perspective view of the oral care system of FIG. 1A, with the toothbrush in its extended ready-for-use position.

A fully assembled oral care system is depicted in FIG. 14. Using the knob 56 and track 6 (refer to FIG. 1B), the brush 10, may be extended to the deployed position and retracted to the stowed position. The brush 10 can be locked in either place using the upper slot 7 and lower slot 67 (refer to FIG. 1B). The upper slot 7 and lower slot 67 join the longitudinally extending track 6 along a common lateral side of the track for intuitive use when locking the brush 10 in either respective position by pressing the knob 56 in either slot. The stream of toothpaste dispensed from the capsule 64 onto the bristles 12 is broken when the brush 10 is extended distally from the main body 1 (refer to FIG. 13B). Secondarily, the elongated lower bristles 16 (refer to FIG. 2A-2B), which are longer than some or all of the other bristles, complete the severance of toothpaste. A cross slit silicone dispensing valve (not shown) at the port 60 may be used for additional toothpaste flow control. The knob 56 is pressed into the upper slot 7 (refer to FIG. 1B) to secure the brush 10 in place for brushing one's teeth. The extended brace stabilizer 8 (refer to FIG. 2B) is designed to support the brush 10 in the fully extended deployed position.

Figure 15:
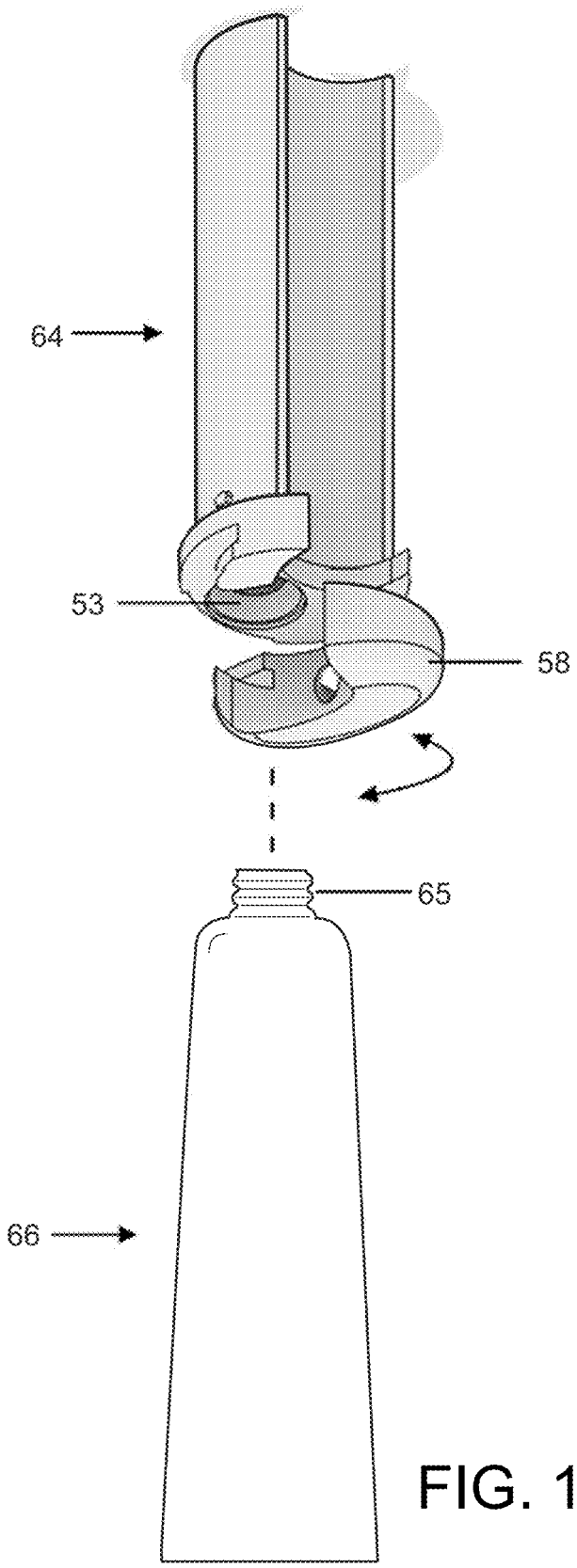
FIG. 15 is a perspective view illustrating the refilling of the toothpaste capsule of the oral care system of FIG. 1A.

The capsule 64 can be refilled through the cap 58 using a standard tube of toothpaste. The cap 58 of the capsule 64 is placed in an open position, as shown in FIG. 15. The exposed nozzle orifice 53 aligns with the nozzle 65 of the toothpaste tube 66. Toothpaste is manually squeezed into the capsule reservoir 57 (refer to FIG. 10B) through the nozzle orifice 53 to a certain fill line (not shown). In this manner, the practical design allows the consumer to use commercially available off-the-shelf toothpaste tubes to fill the capsule 64. It will be appreciated that contrary to existing systems, the capsule 64 of the present inventive system serves as a reservoir for toothpaste so that the toothpaste does not encounter components of the system that actuate the plunger 32 to expel the toothpaste. This is significant as the toothpaste does not act as a contaminant that prohibits the movement of system components.

According to a second described embodiment, illustrated in whole and in part in various views in FIGS. 16A-26, a manually operated oral care system 200 consists of a toothbrush, toothpaste, and floss housed in a single hand-held device. From a port on the device's dispensing cap, toothpaste is manually expelled by compression onto the bristles of an adjacently positioned toothbrush. The toothbrush, with paste, is fully extended and locked in a rotated position for brushing. The dispensing cap may be removed to access a reusable toothpaste capsule that is conveniently refilled by the consumer once extracted. Floss is housed and dispensed at the distal end of the device.

The main body consists of an inner channel and outer channel. The interior walls of both inner channel and outer channel consist of helixes that are formed and spaced for precise positioning of adjoining components. The brush assembly consists of a brush head and brush body, which is also described as a stem herein. The brush head has an elongated distal end that attaches to the brush body latitudinally. The brush head is detachable for convenient periodic replacement to promote sanitary use conditions and accommodate standard wear and tear. A tongue scraper is included on the back of the brush head.

The brush body is operably coupled at its distal end, away from the adjoining brush head, with a brush actuator. The brush assembly and brush actuator reside in the main body of the device's outer channel. The brush assembly is extendable and retractable by the brush actuator, which is fitted in helixes situated in the interior wall of the device's outer channel. During full extension, the brush assembly is rotated by a certain degree allowing the brush actuator to slide into a side-slot on the main body of the device to lock the brush assembly in place for brushing.

The toothpaste dispensing cap, offered in a variety of decorative choices, is screwed onto the main body of the device as it joins with the toothpaste capsule housed in the main body. A sliding door covers the dispensing port on the toothpaste dispensing cap to protect the toothpaste held in a capsule housed in the main body's inner channel. The door is opened to dispense toothpaste onto the brush head. Once the toothpaste dispensing cap is detached, the capsule is removed from the device to be filled with paste by the consumer using commercially available off-the-shelf toothpaste tubes.

The plunger compresses toothpaste in the toothpaste capsule to expel it through a port on the toothpaste dispensing cap and directly onto the facing bristles of the brush head. The port's design and rotation of the brush assembly causes a break in the paste as the brush assembly is extended distally from the device's outer channel. This breaks the paste as the brush assembly is extended and automatically expels and dispenses a repeatable and standard amount of toothpaste onto the brush head.

The plunger is driven by the manual rotation of a coupled plunger actuator attached through the inner channel of the main body of the device. The plunger moves up and down the capsule by its arms moving through helixes in the interior wall of the inner channel of the main body of the device. The plunger actuator is manually rotated by its protruded base to drive the plunger up and down the main body of the device to compress and dispense paste. The base of the plunger actuator has a compartment to hold dental floss, and a dental floss cutter is attached to the plunger actuator's base.

Figure 16A:
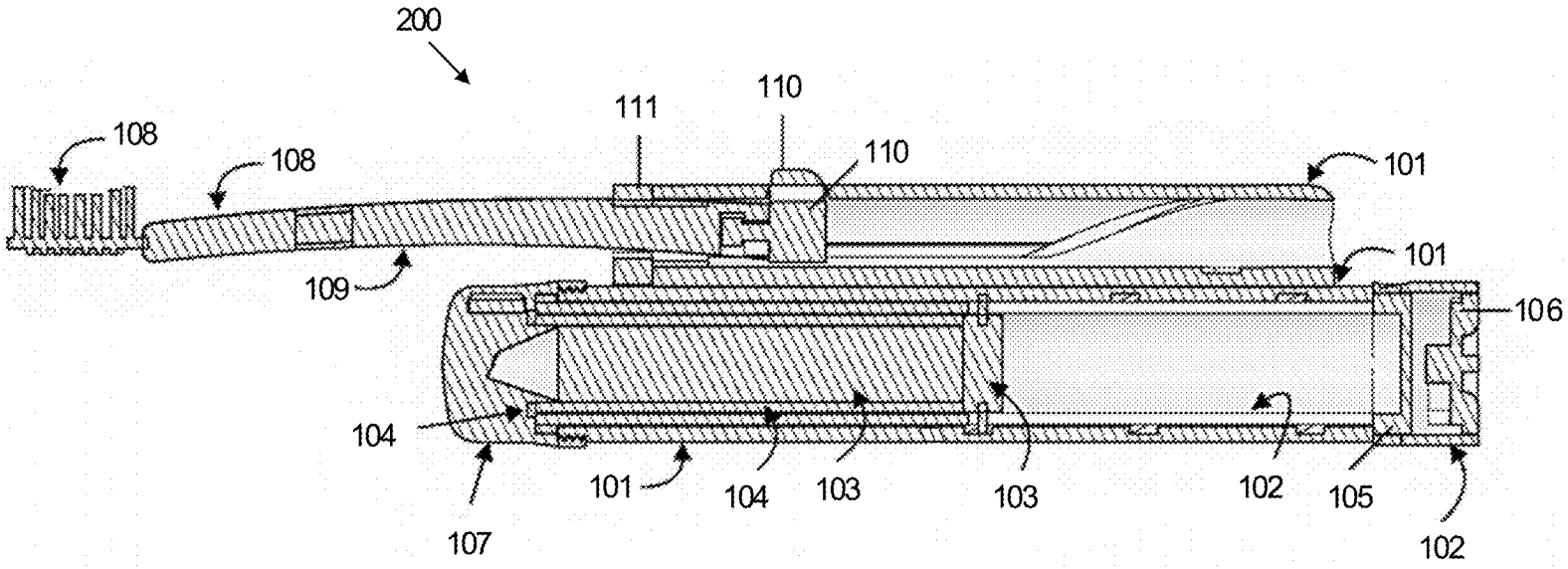
FIG. 16A is a cross-sectional view of an oral care system, according to at least one embodiment, further illustrated in whole or in part in FIGS. 16B-26, the below brief descriptions of which refer to same.
Figure 16B:
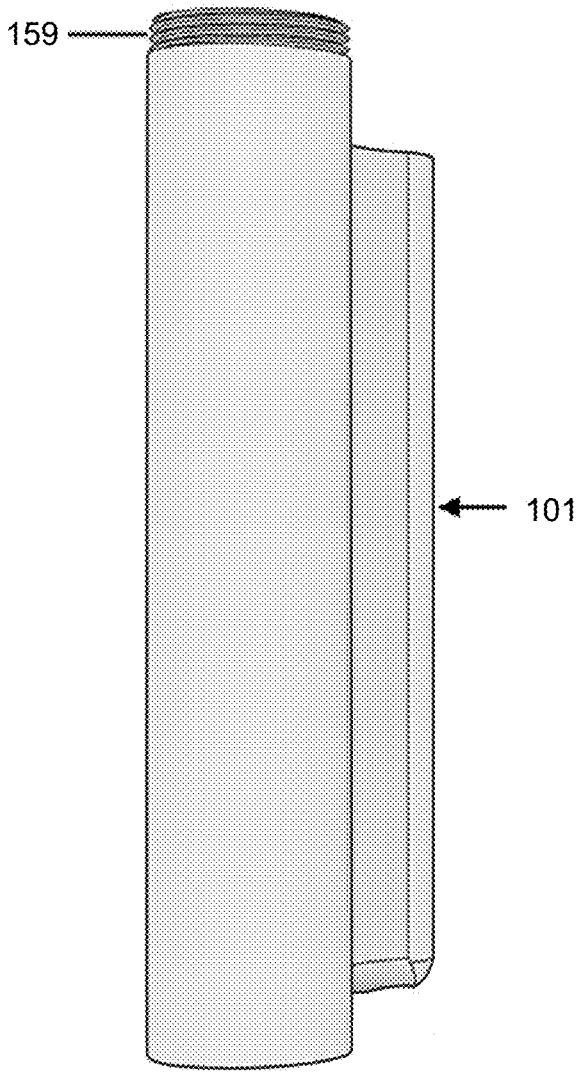
FIG. 16B is a perspective view of the main body.
Figure 16C:
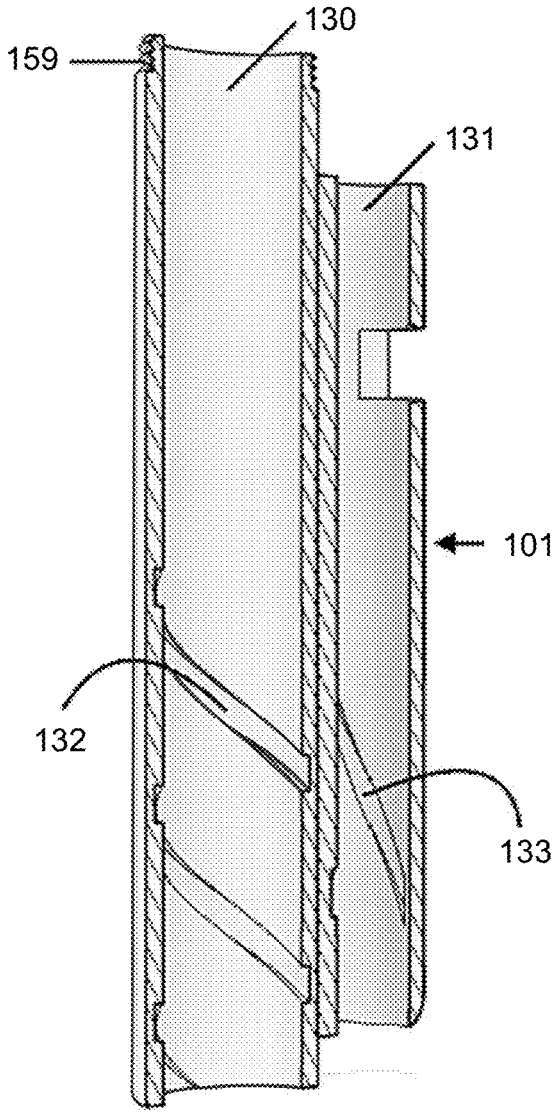
FIG. 16C is a perspective cross-sectional view of the main body.

FIG. 16A shows the main body 101 and its threaded top 159 is shown in FIG. 16C. FIG. 16C shows a cross-sectional view of the main body 101, which consists of a large central inner channel 130 and a narrower outward outer channel 131. The interior wall of the inner channel 130 has an inner channel helix 132 starting from its base and extending upward before terminating at a configurable, predetermined distance. The interior wall of the outer channel 131 has an outer channel helix 133 starting from its base and extending upward before terminating at a specific distance. The inner channel helix 132 is formed at the same slope or angle as the outer channel helix 133 with the same spacing between helices so that the helices can mate and allow the components to turn relative to one another.

Figure 17:
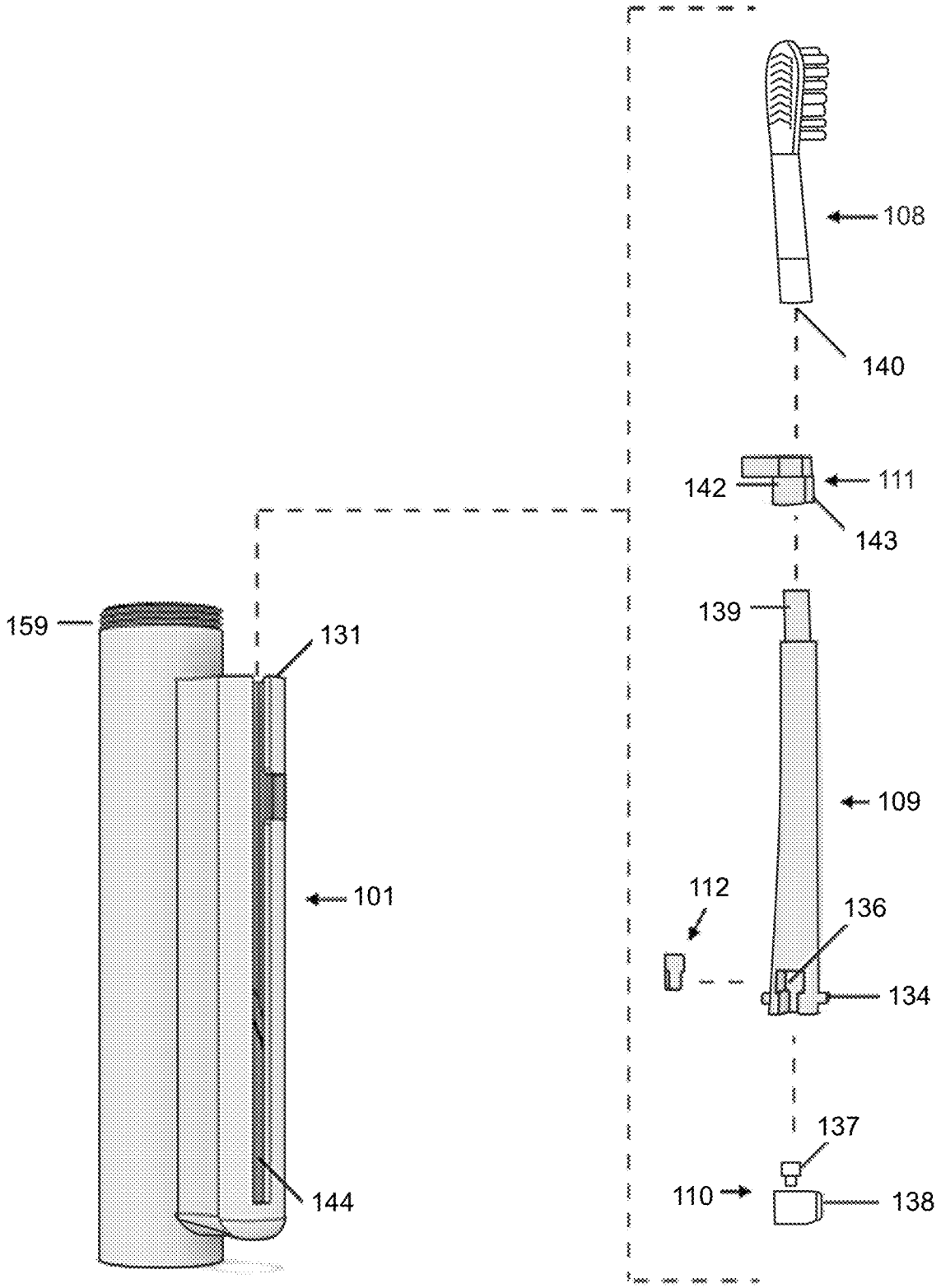
FIG. 17 is an exploded perspective view showing the main body rotated relative to FIG. 16B and components of the brush assembly.

Turning to FIG. 17, the brush actuator peg 137 of the brush actuator 110 is inserted into a peg recess 136 of the brush body or stem 109 and held in place with the peg recess cover 112. The brush body stabilizer 111 has an elongated end 142, which slips over and past the brush body peg 139 of the brush body or stem 109. The brush head recess 140 of the brush head 108 connects to the brush body peg 139. The aforementioned interconnected components are inserted into the outer channel 131 of the main body 101 (refer to FIG. 16C) with the protruding brush actuator knob 138 of the brush actuator 110 and the brush body guide 143 of the brush body stabilizer 111 sliding into the outer channel slot 144 of the outer channel 131. The protruding brush body arms 134 of the brush body 109 engage the outer channel helix 133 of the outer channel 131 (refer to FIG. 16C). The top of the elongated end 142 of the brush body stabilizer 111 rests and is affixed with an adhesive to the top of the outer channel 131 of the main body 101 or other affixing means known to one of skill in the art. The brush body stabilizer 111 supports the brush body 109 during operation by frictionally engaging the sidewalls of brush body 109 while the brush body 109 translates vertically upward or downward during operation. Thus, the brush body stabilizer 111 thereby prevents the brush body from translating horizontally or radially during operation.

Figure 18:
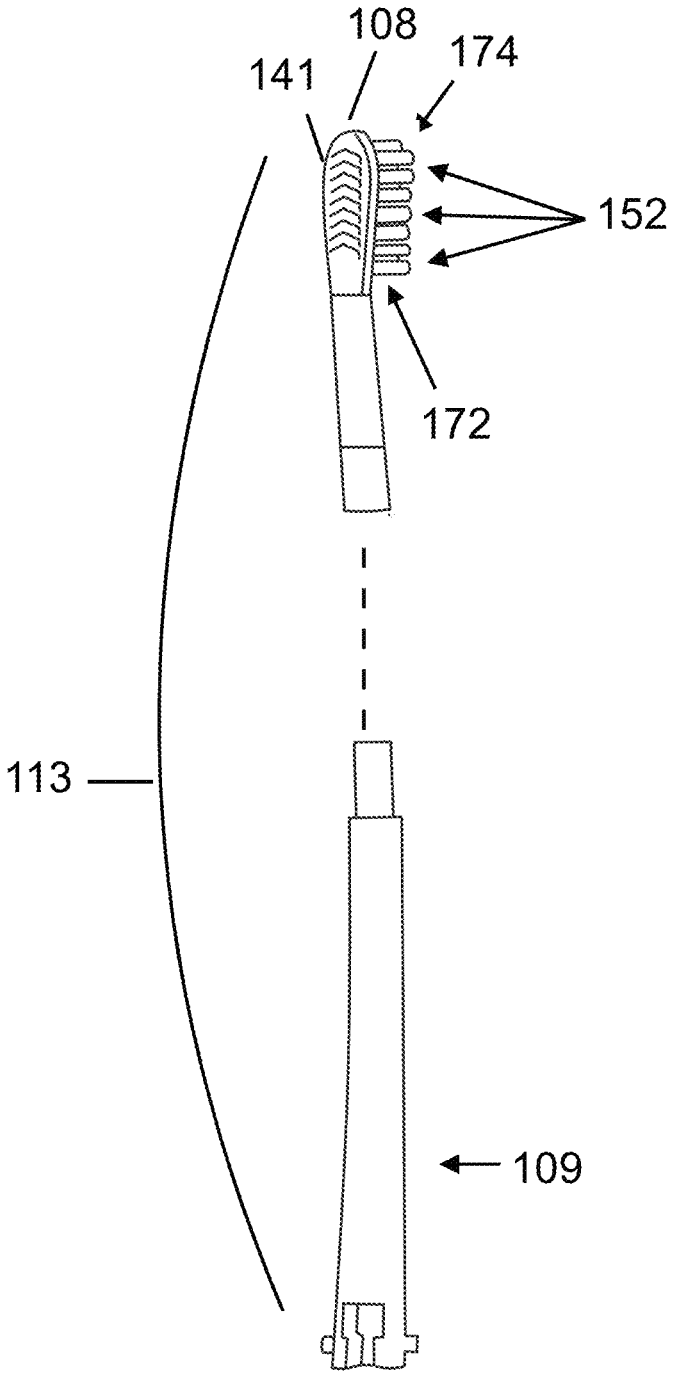
FIG. 18 is an exploded elevation view of the brush assembly.

FIG. 18 is an elevation view of the brush assembly 113 including a brush head 108 affixed a brush body 109 for use. A tongue scraper 141 exists on the back of the brush head 108 opposite the bristles 172. The brush head 108 is replaceable as one or separate units. The bristles 172 are attached at their first ends to the head 108 and extend therefrom to their distal ends 174 opposite the first ends. The distal ends 174 together define a brush bristle surface 152 that serves as a deformable working surface for tooth cleaning in use. A portion of the main body 101, for example between brush body 109 and actuator knob 138, serves as a handle for grasping by a user to manually move the entirety of the oral care system, and the brush head 108 therewith, when brushing his or her teeth.

Figure 19A:
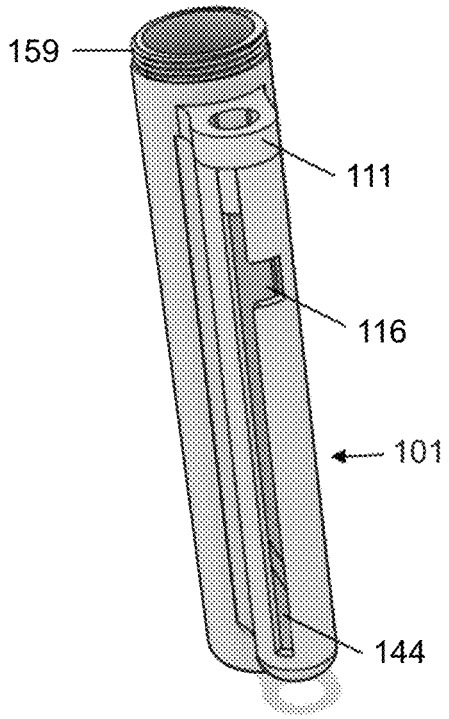
FIG. 19A is another perspective view of the main body.

FIG. 19A is a perspective view of the main body 101 with an outer channel side-slot 116. Referring to perspective view FIG. 19B, the protruding brush actuator knob 138 of the brush actuator 110 (refer to FIG. 17) traverses the outer channel slot 144 to extend and retract the brush assembly 113. While the brush assembly 113 is extended for brushing, the protruding brush actuator knob 138 is pushed into the outer channel side-slot 116 (refer to FIG. 19A) to hold the brush assembly 113 in place. While the brush assembly 113 traverses the outer channel slot 144, the protruding brush body arms 134 of the brush body 109 (refer to FIG. 17) engage the outer channel helix 133 of the outer channel 131 (refer to FIG. 16C). The engagement of the protruding brush body arms 134 with the outer channel helix 133 of the outer channel 131 causes rotation of the brush assembly 113 (refer to FIG. 16C and FIG. 17).

Figure 20A:
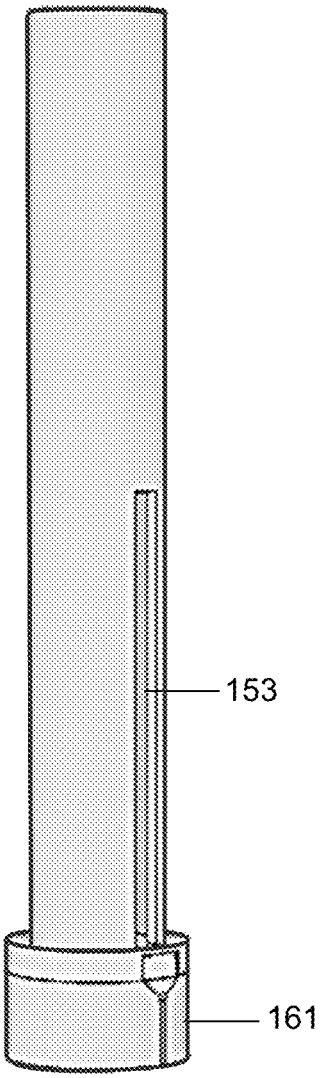
FIG. 20A is a perspective view of components of the toothpaste dispensing apparatus.
Figure 20B:
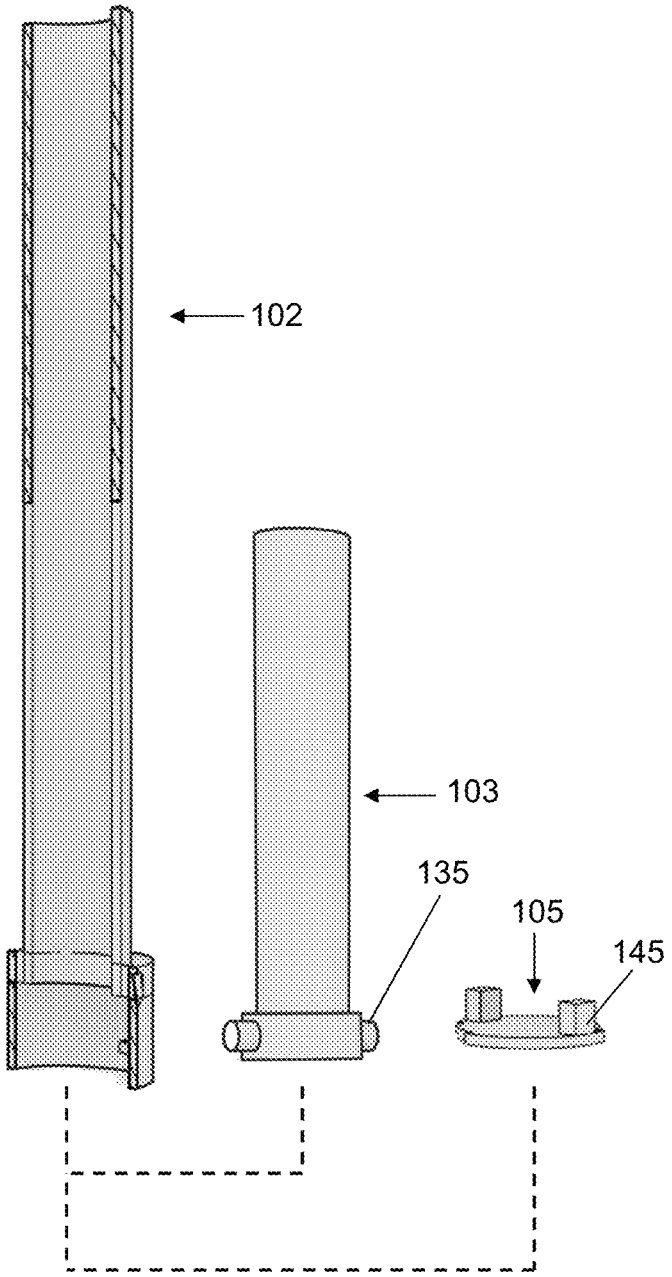
FIG. 20B is an exploded perspective view of the components of the toothpaste dispensing apparatus.

The plunger actuator 102 is shown in FIGS. 20A-20B and has an open elongated cylindrical body with an integrated rotational handle compartment 161 at an open first end. Commencing from the top of the integrated rotational handle compartment 161 and continuing upward until terminating at a certain distance are two symmetrically positioned plunger actuator slots 153. A plunger 103 has a solid elongated cylindrical body with an integrated boss base having two protruding plunger pegs 135.

Figure 20C:
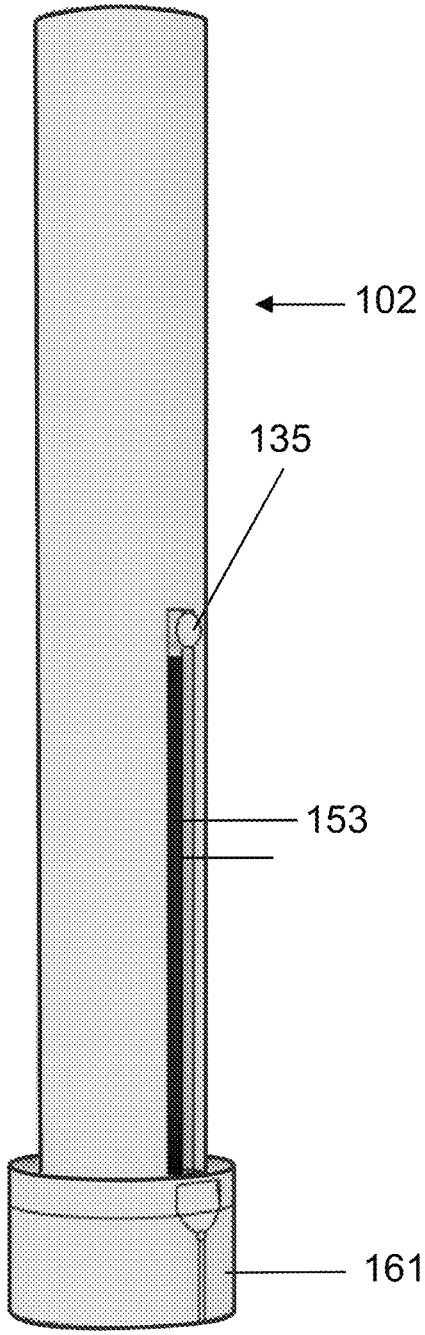
FIG. 20C is a perspective view of components of the toothpaste dispensing apparatus with the plunger at a raised position.

The plunger 103 is inserted through the integrated rotational handle compartment 161 and the open first end of the plunger actuator 102 where the plunger 103 is housed such that the protruding plunger pegs 135 are engaged with the plunger actuator slots 153 (refer to FIG. 20A). Plunger seal 105 is inserted through the open first end of the plunger actuator 102 to secure the plunger 103, which is housed in the plunger actuator 102. When the plunger seal 105 is inserted into the open first end of the plunger actuator 102, two symmetrical plunger seal pegs 145 of the plunger seal 105 engage the plunger actuator slots 153 (refer to FIG. 20A). FIG. 20C shows the protruding plunger pegs 135 of the plunger 103 (refer to FIG. 20B) housed in the plunger actuator 102.

Figure 21A:
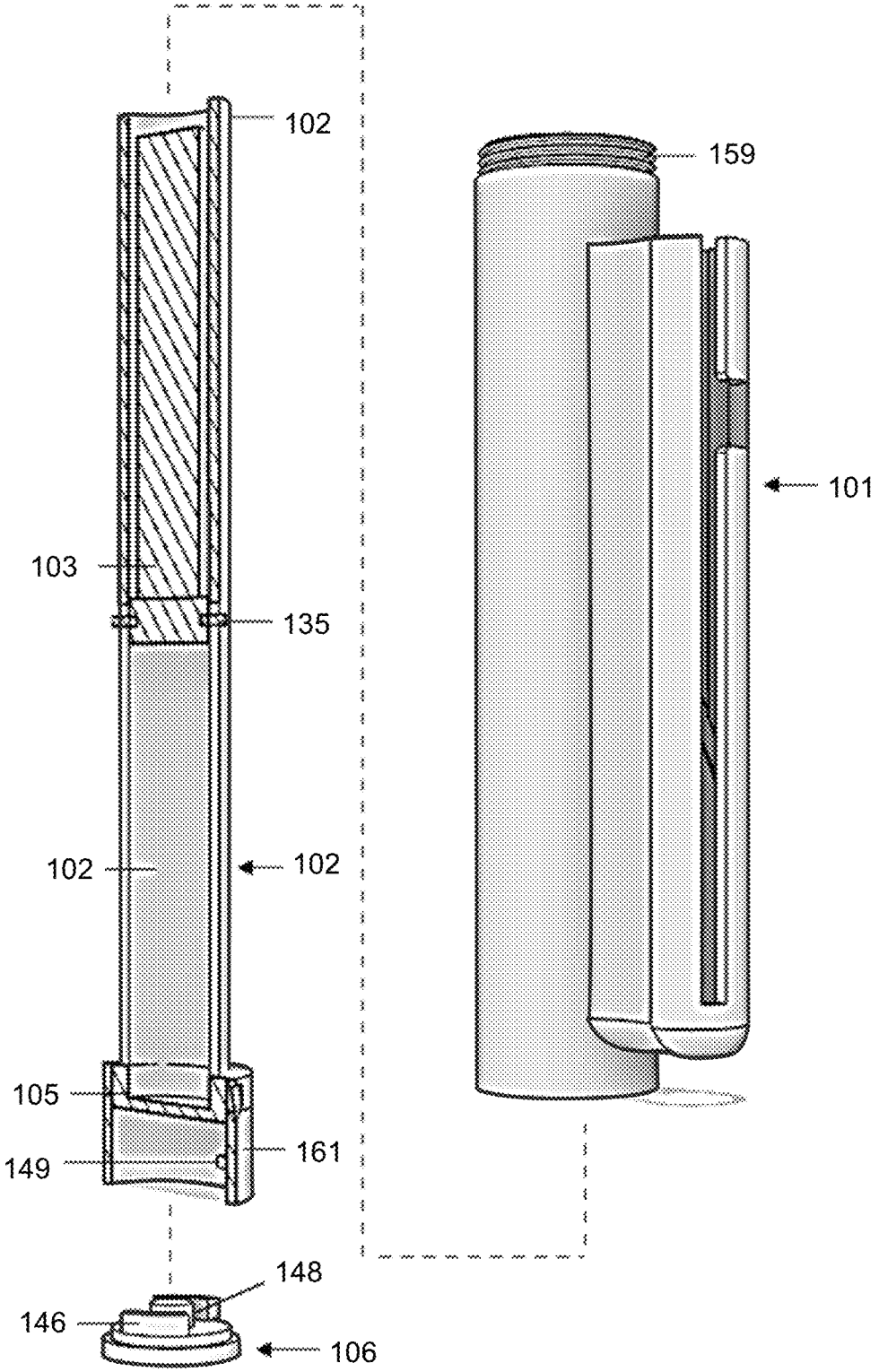
FIG. 21A is a perspective view of components of the toothpaste dispensing apparatus with the plunger shown in cross-sectional view at a raised position.

An embodiment of a rotational handle compartment cap 106 is depicted in FIG. 21A and includes a flat, circularly shape based with two symmetrically vertical rotational handle compartment cap locking arms 146 and a centrally located rotational handle compartment cap spool post 148 for holding dental floss. The rotational handle compartment cap 106 closes the integrated rotational handle compartment 161 of the plunger actuator 102 when the rotational handle compartment ledge 149 and rotational handle compartment cap locking arms 146 are engaged. The plunger actuator 102 and interconnected components (plunger 103, plunger seal 105, rotational handle compartment cap 106) are inserted into the inner channel 130 (refer to FIG. 16C) of the main body 101.

Figure 21B:
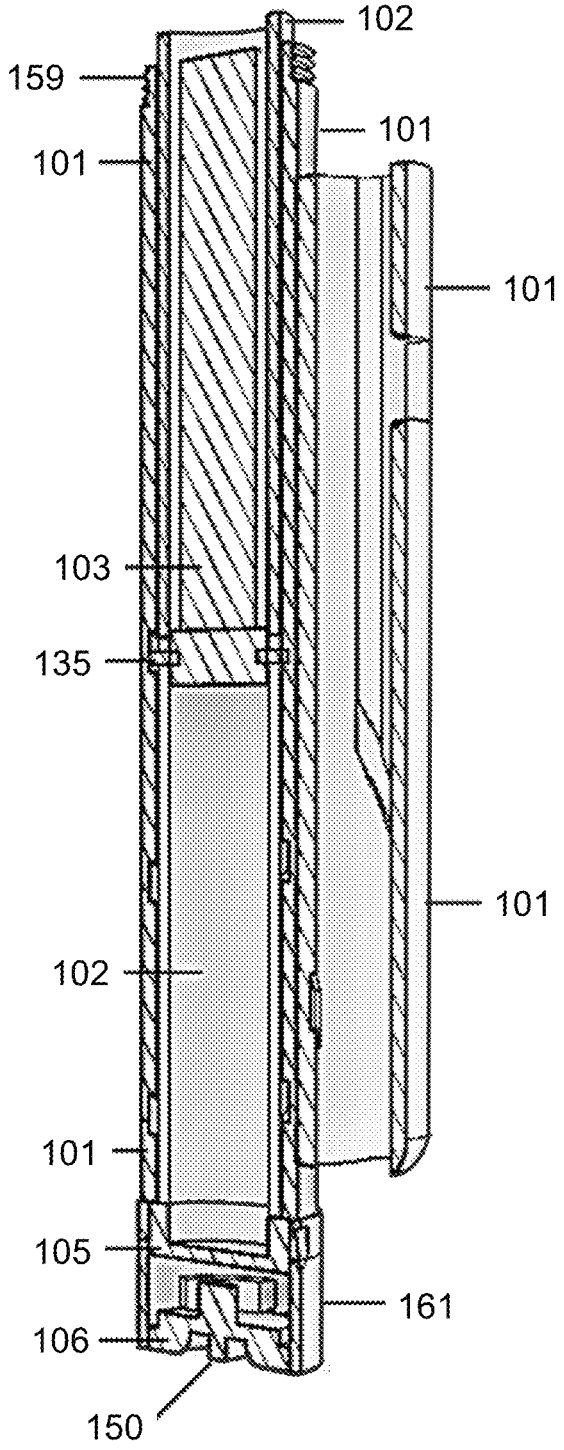
FIG. 21B is a perspective view of components of the toothpaste dispensing apparatus shown in cross-sectional view with the plunger at a raised position.

FIG. 21B shows a cross-sectional view of the main body 101 joined with the plunger actuator 102 and its interconnected components (plunger 103, plunger seal 105, rotational handle compartment cap 106). A rotational handle compartment cap grip 150 is used to apply and remove the rotational handle compartment cap 106 to the integrated rotational handle compartment 161 of the plunger actuator 102.

Figure 22:
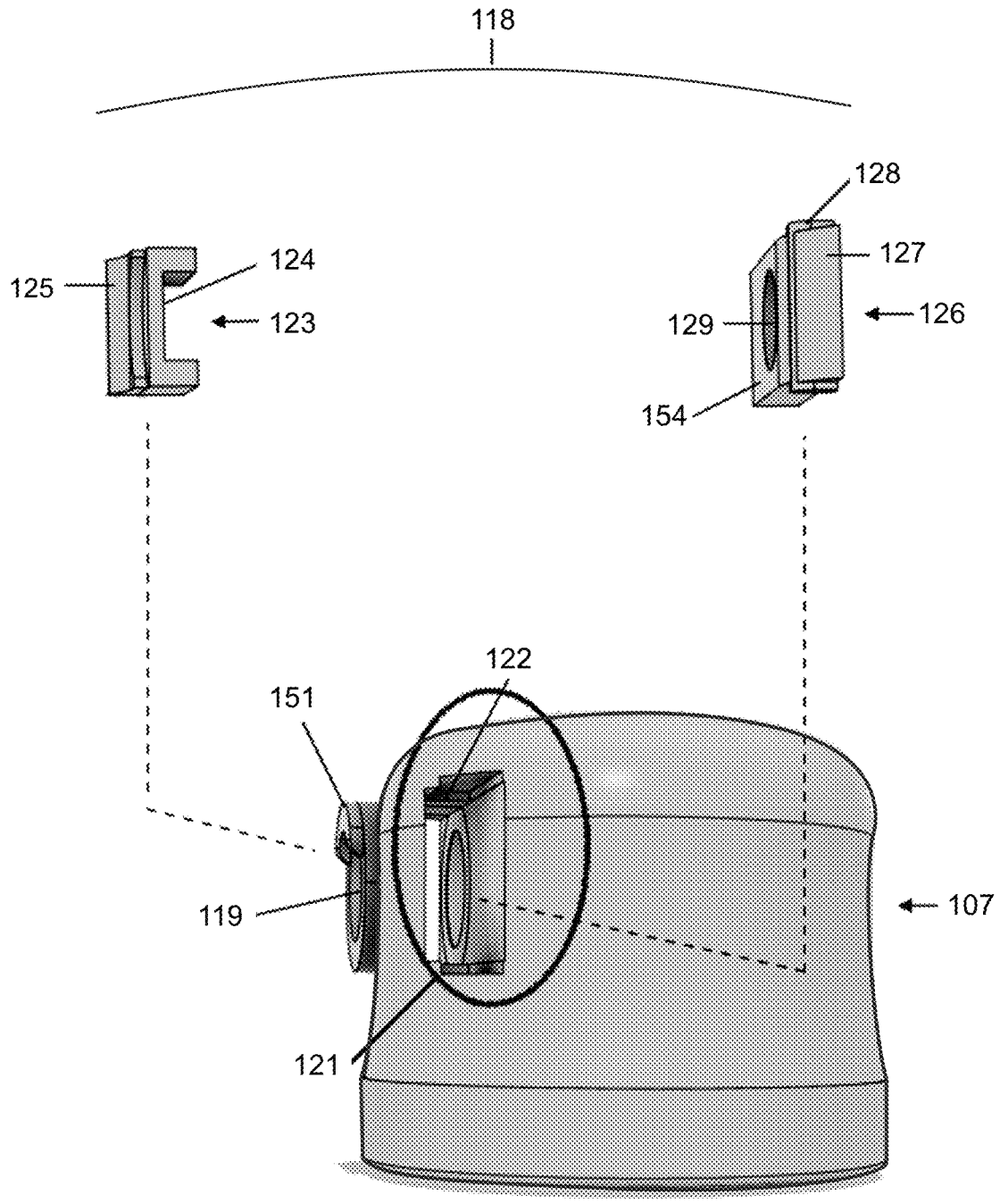
FIG. 22 is an exploded perspective view of the toothpaste dispensing cap.

FIG. 22 illustrates a toothpaste dispensing cap 107 including a circular toothpaste dispensing cap port 129 and a port rim 151, a toothpaste dispensing cap door housing 121 with a housing door inhibitor 122, and a dispensing cap door 118. The dispensing cap door 118 consists of a door body 126 and a door grip 123. The door body 126 includes a curved frontal component 127, an extending notch component 128 for restricting motion, a port opening component 129 for expelling toothpaste, and a connecting surface component 154 for interfacing with the door grip 123.

The door body's 126 end opposite the curved frontal component 127 is inserted into the toothpaste dispensing cap door housing 121. The door grip 123 includes a connecting surface recess component 124 and a ledge component 125. The door grip 123 is connected to the door body 126 by affixing the connecting surface recess component 124 to the connecting surface component 154. Once the connection is established, the assembled dispensing cap door 118 is secured within the cap door housing 121 such that the dispensing cap door 118 will translate within the door cap housing 121 during normal operating conditions without becoming removed, as described more fully below.

Figure 23A:
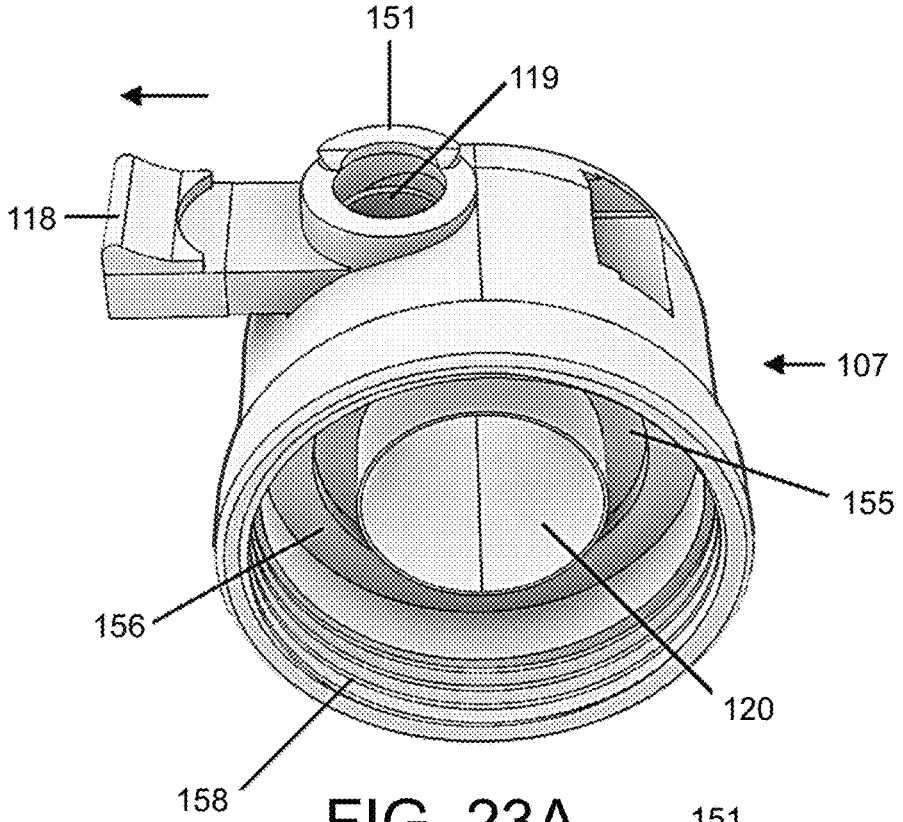
FIG. 23A is an assembled perspective view of the toothpaste dispensing cap shown with the door in its open position.
Figure 23B:
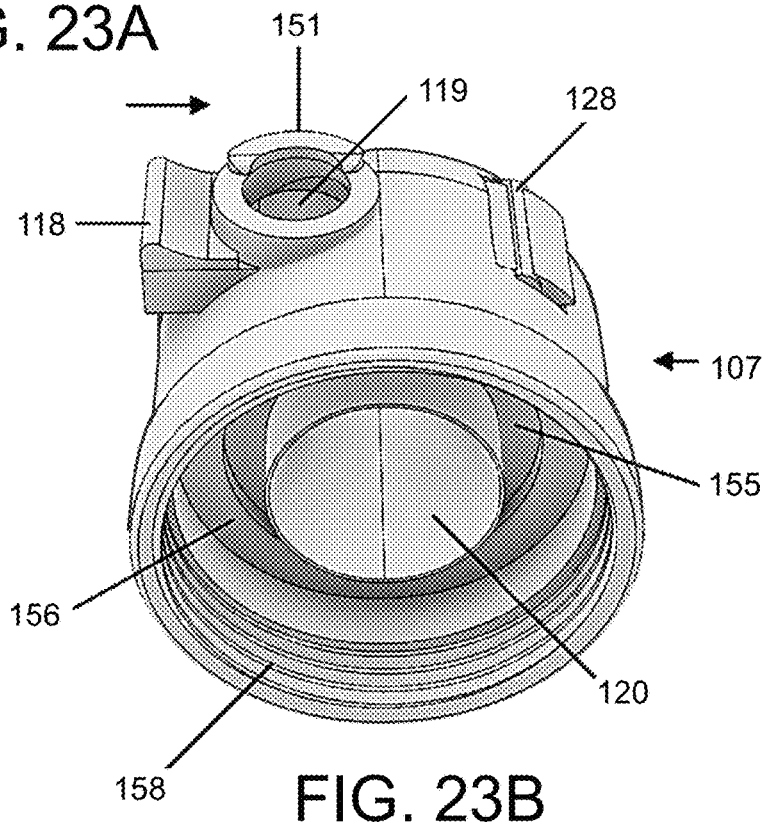
FIG. 23B is an assembled perspective view of the toothpaste dispensing cap shown with the door in its closed position.
Figure 23C:
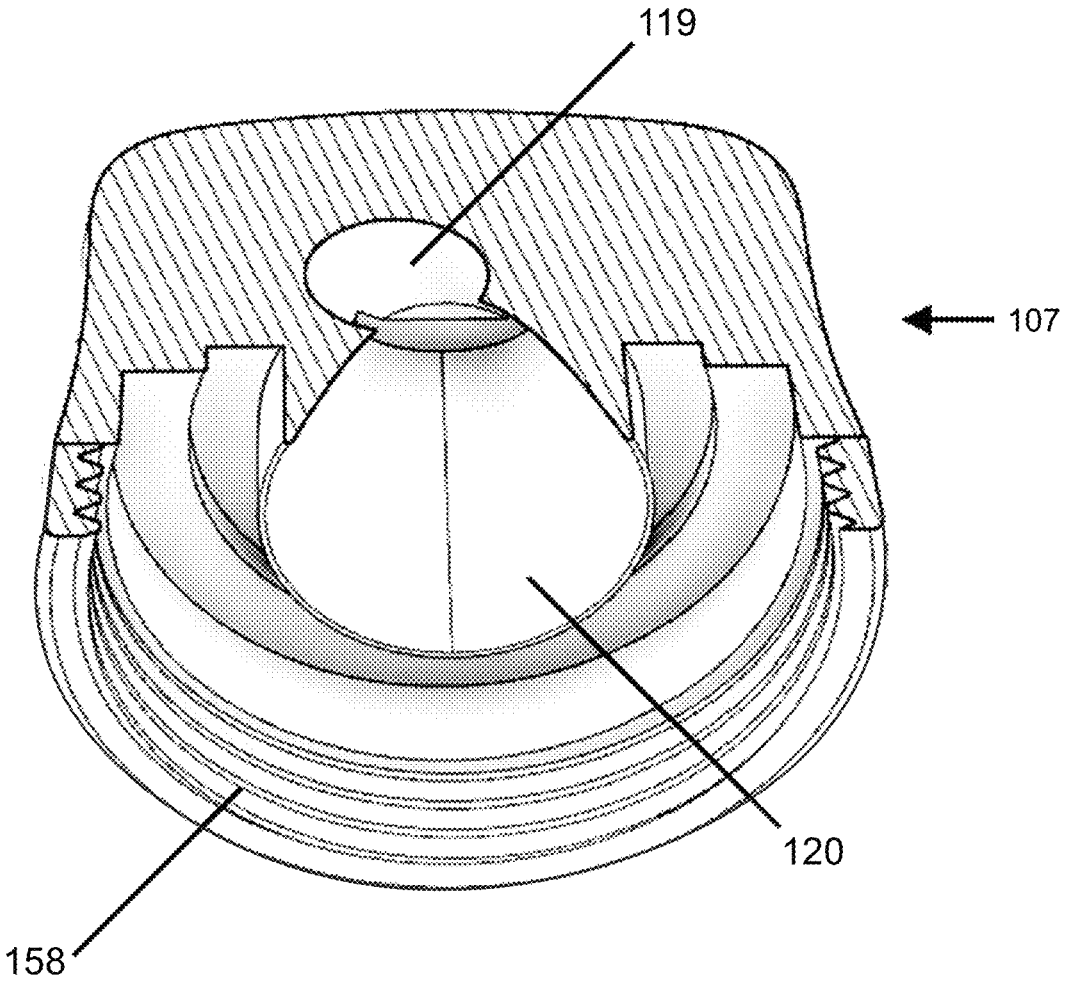
FIG. 23C is a cross-sectional perspective view of the dispensing cap.

Referring to FIGS. 23A-23C, the toothpaste dispensing cap 107 features a central internal cavity 120 that extends through the toothpaste dispensing cap port 119. An upper rim 155 and lower rim 156 surround the central internal cavity 120. Integrated threads 158 allow fastening to the accompanying threaded top 159 of main body 101 (refer to FIG. 16B). The port opening component 129 (refer to FIG. 22) of the dispensing cap door 118 opens and closes the toothpaste dispensing cap port 119. The housing door inhibitor 122 (refer to FIG. 22) abuts the notch component 128, thereby restricting the dispensing cap door's 118 range of motion. In an opened position, the port opening component 129 (refer to FIG. 22) of the dispensing cap door 118 aligns with the opening of the toothpaste dispensing cap port 119. In a closed position, the port opening component 129 (refer to FIG. 22) covers the opening of the toothpaste dispensing cap port 119.

Figure 24:
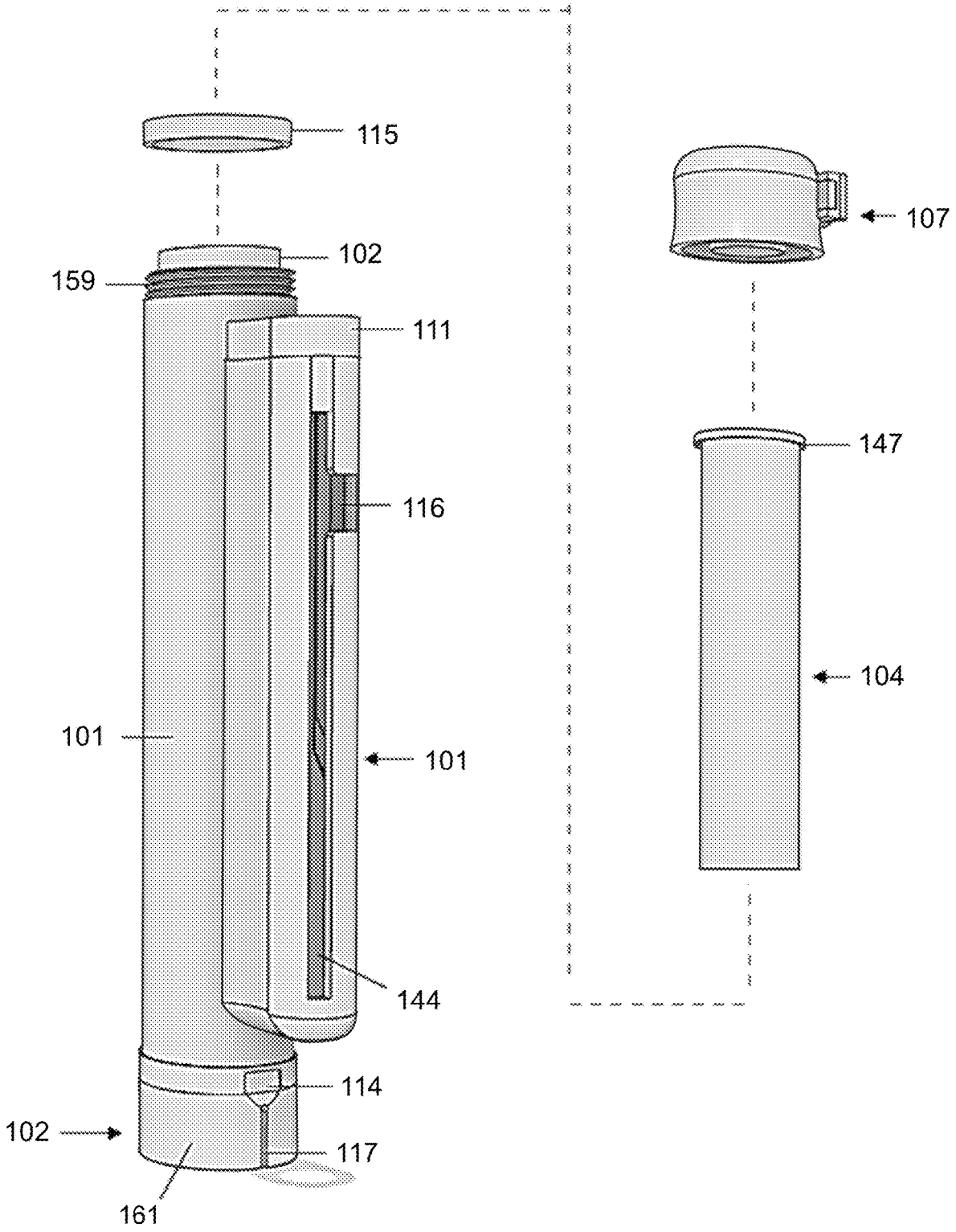
FIG. 24 is an exploded perspective view of the oral care system of FIG. 16A.

Turning to FIG. 24, the plunger actuator 102 and interconnected components (refer to FIGS. 20A-20C and FIGS. 21A-21B) are coupled with the main body 101 by affixing the plunger actuator ring 115 over the plunger actuator 102, which protrudes from the top of the main body 101. A toothpaste capsule 104, having open ends and a hollow body, has a toothpaste capsule rim 147 located on one end. The end of the toothpaste capsule 104 opposite the toothpaste capsule rim 147 is inserted into the plunger actuator 102 that is affixed to the main body 101. The toothpaste capsule rim 147 rests on the top of the joined plunger actuator 102 and plunger actuator ring 115.

The toothpaste dispensing cap 107 has integrated threads 158 (refer to FIGS. 23A-23C) that are screwed to the threaded top 159 of the main body 101. A central internal cavity 120 of the toothpaste dispensing cap 107 rests in the toothpaste capsule 104 while the lower rim 156 of the cap 107 abuts the plunger actuator ring 115 and the upper rim 155 abuts the toothpaste capsule rim 147 (refer to FIGS. 23A-23C). A dental floss cutter 114 and dental floss dispensing slot 117 (refer to FIGS. 20A-20C) can be formed as integral with, or can be coupled to, the integrated rotational handle compartment 161 at the end of the plunger actuator 102.

Figure 25:
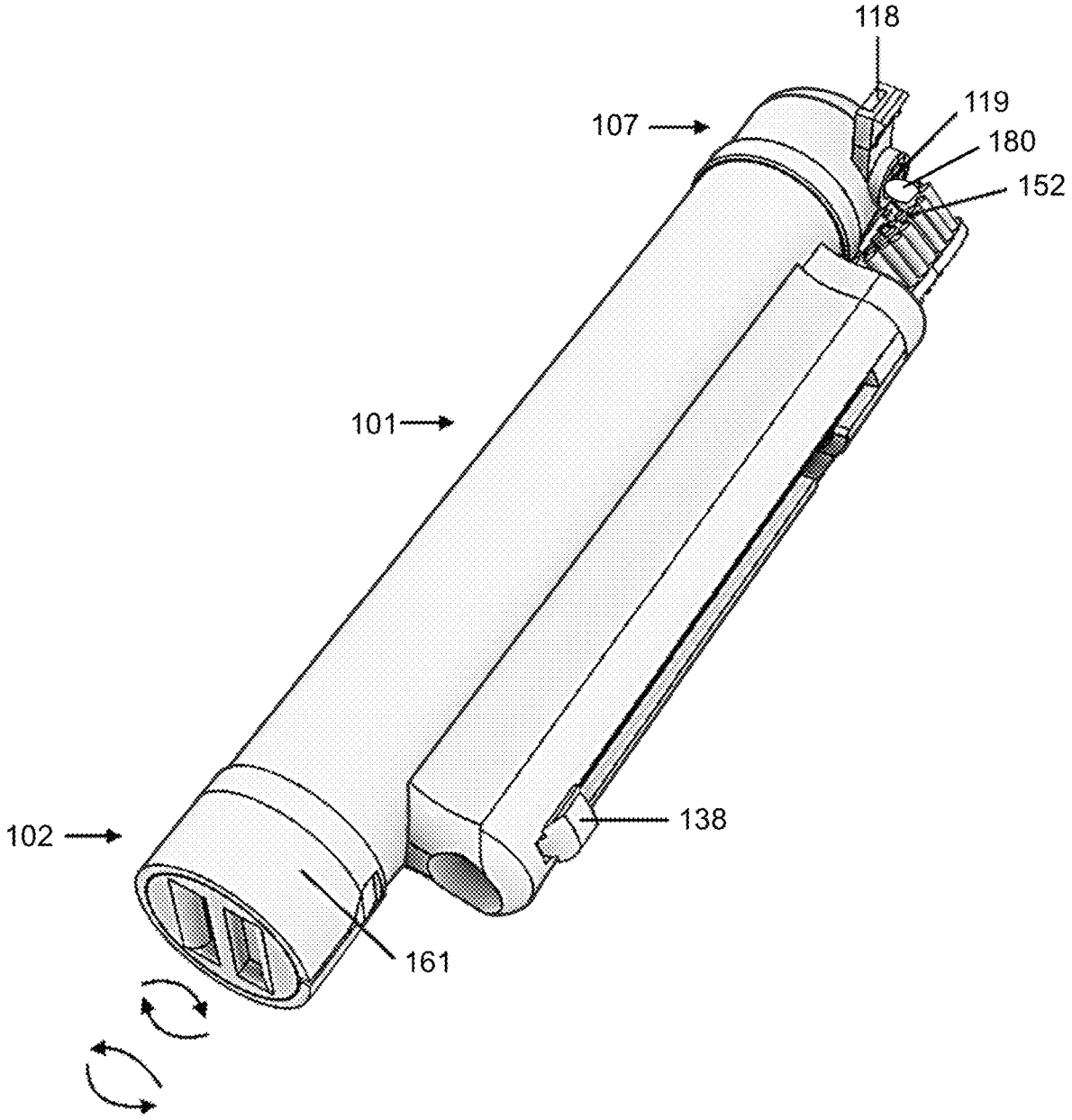
FIG. 25 is a perspective view of the oral care system of FIG. 16A showing the brush assembly in position receiving toothpaste directly onto the brush surface.

Referring to FIG. 25, the main body 101 and interconnected components (refer to FIGS. 16A-24) work in harmony to expel toothpaste housed in the device onto the brush. With the dispensing cap door 118 opened and the brush assembly 113 in a dispensing position, referring to the protruding brush actuator knob 138 (FIG. 19B) in a full downward position, the integrated rotational handle compartment 161 end of the plunger actuator 102 can be manually rotated clockwise to actuate the plunger upward in the capsule thereby pressing toothpaste through the central internal cavity 120 of the toothpaste dispensing cap 107 (refer to FIGS. 23A-23C), the dispensing cap door's 118 port opening component 129 (refer to FIG. 22), and through the toothpaste dispensing cap port 119. Toothpaste 180 (FIG. 25) is placed directly onto the brush bristle surface 152. The integrated rotational handle compartment 161 end of the plunger actuator 102 is manually rotated counter-clockwise to retract the plunger 103 (refer to FIGS. 21A-21B and FIG. 24) and facilitate removal of the toothpaste capsule 104 for refilling.

The capsule 104, with the cap 107, and manually rotatable actuator 102 thus define, in cooperation with the main body 101, a toothpaste dispensing apparatus by which toothpaste is placed directly onto the brush bristle surface 152 at the distal ends 174 of the bristles 172 (refer to FIG. 18). This advantageously conserves toothpaste and minimizes deep saturation of the bristles 172 at their first ends attached to the head 108 serving both aesthetic and sanitary purposes by minimizing accumulation between uses.

Figure 19B:
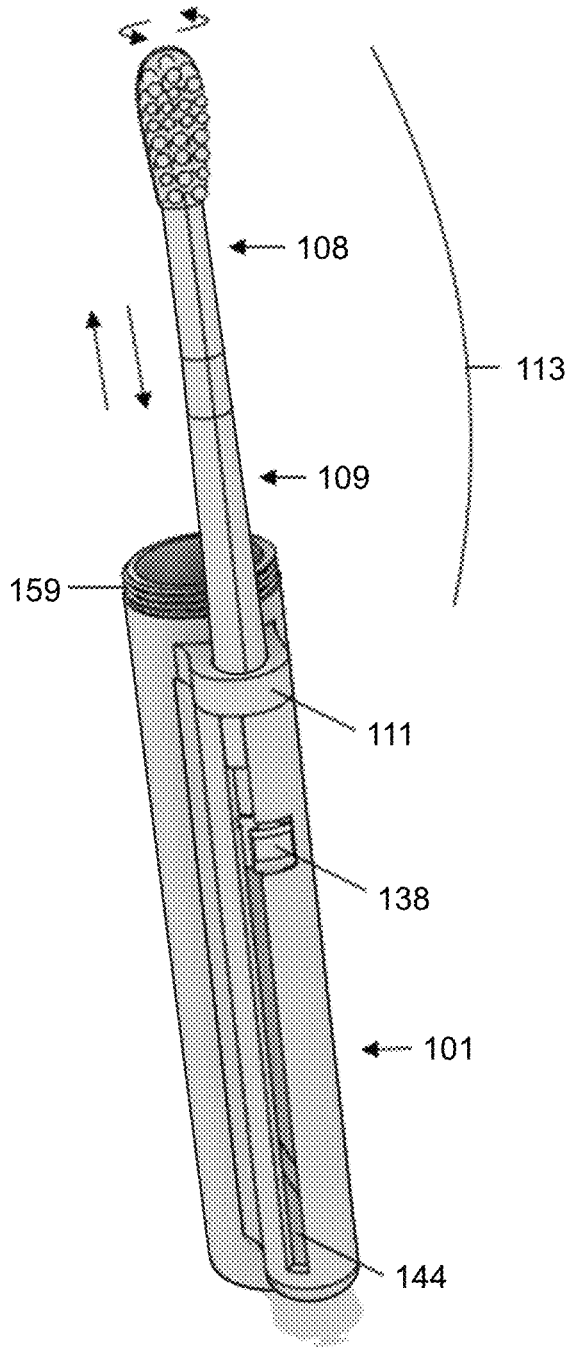
FIG. 19B is a perspective view of the main body with the brush assembly extended to its ready-for-use position.

Once paste is dispensed, using the protruding brush actuator knob 138, the brush assembly 113 can be extended and locked for brushing (refer to FIGS. 19A-19B). While the brush assembly 113 is extended distally from the main body 101, the port rim 151 (refer to FIG. 22) of the toothpaste dispensing cap port 119 breaks the paste from the dispensing cap port 119. The brush assembly 113 is extended using a separate actuator than the actuator used to actuate the plunger 103 and expel toothpaste from the dispensing cap 107.

Figure 26:
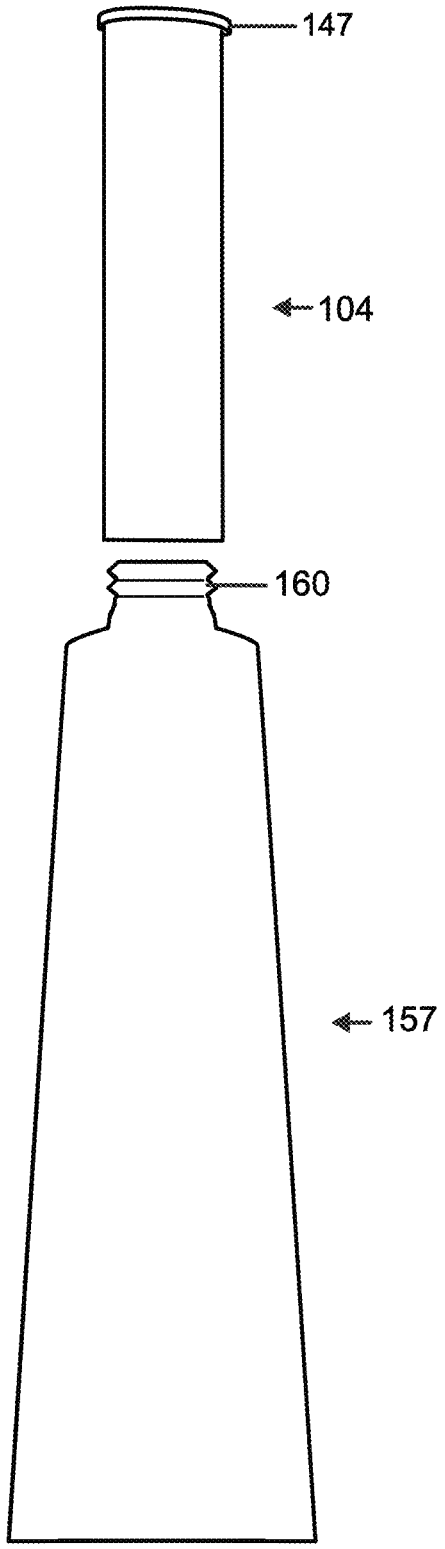
FIG. 26 is a perspective view representing the refilling of the toothpaste capsule of the oral care system of FIG. 16A.

FIG. 26 shows the toothpaste capsule 104 removed from the main body 101. The end of the hallow toothpaste capsule 104 opposite the toothpaste capsule rim 147, fits over the nozzle 160 of a collapsible toothpaste tube 157. Subsequently, toothpaste is manually squeezed into the toothpaste capsule 104 from the bottom up. It will be appreciated that contrary to existing systems, the toothpaste capsule 104 of the present inventive system provides a reservoir for the toothpaste so that the toothpaste does not contact the components of the system that actuate the plunger 103 to expel the toothpaste. This is significant as the toothpaste does not act as a contaminant that prohibits the movement of system components.

Particular embodiments and features have been described with reference to the drawings. It is to be understood that these descriptions are not limited to any single embodiment or any particular set of features, and that similar embodiments and features may arise, or modifications and additions may be made without departing from the scope of these descriptions and the spirit of the appended claims.

What is claimed is:

1. An oral care system comprising:

(a) a main body;

(b) a brush attached to the main body and manually movable between a stowed position and a deployed position, the brush comprising (i) a head, and (ii) bristles having respective first ends attached to the head and distal ends together defining a bristle surface for tooth cleaning in use; and (c) a dispensing apparatus carried by the main body, wherein (i) the dispensing apparatus further comprises (A) a rotatable actuator, (B) a capsule for containing toothpaste, (C) a port through which toothpaste is dispensed, (D) a post comprising a first portion and a second portion, and (E) a plunger that frictionally engages the capsule by the post, (ii) the port aligns with the bristles when the brush is at the stowed position, (iii) by rotation of the rotatable actuator, (A) toothpaste is dispensed from the capsule through the port and onto the bristle surface defined by distal ends of the bristles, (B) the post is operably extended such that first portion extends telescopically relative to the second portion within the capsule, and (C) toothpaste is compressed by the plunger frictionally engaging the capsule, and thereby toothpaste dispensed from the capsule through the port and onto the bristle surface, and (iv) the dispensing apparatus is configured to place toothpaste directly onto the bristle surface defined by the distal ends of the bristles when the brush is in the stowed position.

2. The oral care system of claim 1, wherein the dispensing apparatus is configured to place toothpaste directly onto the bristle surface defined by the distal ends of the bristles without saturating the bristles at their first ends attached to the head.

3. The oral care system of claim 1, wherein the main body comprises a longitudinal first channel in which the brush is positionable, and a longitudinal second channel for receiving the capsule.

4. The oral care system of claim 1, wherein toothpaste is dispensed from the capsule through the port by manual rotation of the rotatable actuator.

5. The oral care system of claim 1, wherein:

(a) the main body comprises a longitudinally extending track;

(b) the brush further comprises a neck extending from the head;

(c) a knob is secured to a neck of the brush; and (d) the knob extends through the longitudinally extending track and is accessible to a user for moving the brush between the stowed position and the deployed position by longitudinal movement of the knob through at least part of the longitudinally extending track.

6. The oral care system of claim 1, wherein:

(a) the main body comprises, at respective opposing longitudinal ends of the longitudinally extending track, a perpendicular first slot and a perpendicular second slot each adjoining the longitudinally extending track;

(b) the brush is selectively locked in the stowed position by placement of the knob from the track into the first slot; and (c) the brush is selectively locked in the deployed position by placement of the knob from the track into the second slot.

7. The oral care system of claim 6, wherein the first slot and second slot join the track along a common lateral side of the track for use when locking the brush in either the stowed position or deployed position.

8. The oral care system of claim 1, wherein the head of the brush is sunken into the oral care system when in the stowed position.

9. The oral care system of claim 1, wherein the main body further comprises a floss cavity for storing floss and a slit for dispensing floss therethrough from the floss cavity.

10. An oral care system comprising:

(a) a main body; and (b) a brush attached to the main body and manually movable between a stowed position and a deployed position, the brush comprising (i) a head, and (ii) bristles having respective first ends attached to the head and distal ends together defining a bristle surface for tooth cleaning in use; and (c) a dispensing apparatus carried by the main body, wherein (i) the dispensing apparatus further comprises (A) a rotatable actuator, (B) a capsule for containing toothpaste, and (C) a port through which toothpaste is dispensed, (ii) the port aligns with the bristles when the brush is at the stowed position, (iii) the capsule comprises (A) a reservoir for storing toothpaste, (B) a nozzle orifice for receiving toothpaste into the reservoir, and (C) and a cap, (iv) the cap comprises a port, a port orifice, and a port conduit that extends at least partially through the cap between the port orifice and the port, wherein (A) the cap is configurable to an engaged position wherein the port orifice is at least partially aligned with the nozzle orifice, (B) the cap is configurable to an open position wherein the nozzle orifice is exposed to receive toothpaste for filling the capsule, and (C) the cap is pivotable from the open position to the engaged position for dispensing toothpaste, (v) the nozzle orifice is not accessible for filling the capsule when the cap is in the engaged position, (vi) the dispensing apparatus is configured to place toothpaste directly onto the bristle surface defined by the distal ends of the bristles when the brush is in the stowed position, and (vii) by rotation of the rotatable actuator, toothpaste is dispensed from the capsule through the port and onto the bristle surface defined by distal ends of the bristles.

11. An oral care system comprising:

(a) a main body;

(b) a brush coupled to the main body and manually movable between a stowed position and a deployed position, the brush comprising (i) a head, (ii) bristles having respective first ends attached to the head and distal ends together defining a bristle surface for tooth cleaning, and (iii) a neck extending from the head; and (c) a dispensing apparatus carried by the main body, wherein dispensing apparatus comprises, (i) a port through which toothpaste is dispensed, wherein the port aligns with the bristles when the brush is in the stowed position, (ii) a post comprising a first post portion and a second post portion, wherein the second post portion is configured to telescopically translate relative to the first post portion between an extended position and a stowed position, (iii) a capsule configured to contain toothpaste, (iv) a plunger frictionally engaged with the capsule and the post, (v) a rotatable actuator mechanically coupled to the post, wherein (A) by rotation of the rotatable actuator, the second post portion translates to the extended position, thereby extending the plunger, and wherein (B) toothpaste is compressed by the extending plunger, thereby dispensing toothpaste from the capsule through the port and onto the bristle surface.

12. The oral care system of claim 11, wherein the main body comprises a longitudinal first channel in which the brush is positionable, and a longitudinal second channel for receiving the capsule.

13. The oral care system of claim 11, wherein the capsule comprises:

(a) a reservoir for storing toothpaste;

(b) a nozzle orifice for receiving toothpaste into the reservoir; and (c) a cap comprising (i) a port, a port orifice, and a port conduit that extends at least partially through the cap between the port orifice and the port, wherein (ii) the cap is configurable to an engaged position wherein the port orifice is at least partially aligned with the nozzle orifice, and wherein (iii) the cap is configurable to an open position wherein the nozzle orifice is exposed to receive toothpaste for filling the capsule.

* * * * *